US011105135B2

(12) United States Patent
Kondratuk

(10) Patent No.: US 11,105,135 B2
(45) Date of Patent: Aug. 31, 2021

(54) HYDRAULIC DOOR CLOSER WITH FLUID OVERFLOW CHAMBER

(71) Applicant: Larson Manufacturing Company of South Dakota, Inc., Brookings, SD (US)

(72) Inventor: Michael W. Kondratuk, Brookings, SD (US)

(73) Assignee: Larson Manufacturing Company of South Dakota, LLC, Brookings, SD (US)

( * ) Notice: Subject to any disclaimer, the term of this patent is extended or adjusted under 35 U.S.C. 154(b) by 147 days.

(21) Appl. No.: 16/532,159

(22) Filed: Aug. 5, 2019

(65) Prior Publication Data

US 2019/0360251 A1 Nov. 28, 2019

Related U.S. Application Data

(63) Continuation-in-part of application No. 15/392,070, filed on Dec. 28, 2016, now Pat. No. 10,370,885.

(60) Provisional application No. 62/273,759, filed on Dec. 31, 2015.

(51) Int. Cl.
*E05F 3/10* (2006.01)
*E05F 3/12* (2006.01)

(52) U.S. Cl.
CPC ..... *E05F 3/102* (2013.01); *E05F 3/12* (2013.01); *E05Y 2201/474* (2013.01); *E05Y 2900/132* (2013.01)

(58) Field of Classification Search
CPC ..... E05F 3/102; E05F 3/12; E05F 3/14; E05F 3/10; E05Y 2201/264; E05Y 2201/474
USPC ..... 16/49, 51, 58, 59, 62
See application file for complete search history.

(56) References Cited

U.S. PATENT DOCUMENTS 3,665,549 A * 5/1972 Quinn ..... E05F 3/108 16/52
3,852,846 A 12/1974 Slaybaugh
4,068,344 A * 1/1978 Okabe ..... E05F 3/20 16/54
4,080,687 A * 3/1978 Jentsch ..... E05F 3/102 16/51
4,263,694 A * 4/1981 Jentsch ..... A62C 2/12 16/48.5
4,378,612 A 4/1983 Beers
4,580,365 A 4/1986 Sieg
4,660,250 A 4/1987 Tillman et al.
4,847,946 A 7/1989 Nam et al.
4,937,913 A 7/1990 Jentsch
4,967,444 A 11/1990 Körling et al.
5,259,090 A 11/1993 Fayngersh
(Continued)

FOREIGN PATENT DOCUMENTS

EP 0328912 A1 8/1989

*Primary Examiner* — Roberta S Delisle
(74) *Attorney, Agent, or Firm* — Kagan Binder, PLLC

(57) ABSTRACT

This disclosure is generally directed to a hydraulic door closer, and more specifically is directed to a hydraulic storm or screen door closer that has a fluid overflow chamber providing fluid volume and pressure control for both expanded and contracted fluid at different temperatures. The disclosed hydraulic door closer comprises a fluid overflow chamber adapted to hold sufficient fluid to maintain required operating fluid or oil levels at different temperatures, and to ensure proper closer performance under both extreme high and low temperature conditions.

27 Claims, 16 Drawing Sheets

(56) References Cited

U.S. PATENT DOCUMENTS

| | | | | |
|---|---|---|---|---|
| 5,337,448 | A | 8/1994 | Brown | |
| 5,535,514 | A | 7/1996 | Lucas et al. | |
| 5,586,361 | A * | 12/1996 | T olle | E05C 17/305 16/51 |
| 5,850,671 | A | 12/1998 | Käser | |
| 6,345,412 | B1 | 2/2002 | Law | |
| 7,571,515 | B2 | 8/2009 | Fischbach et al. | |
| 7,815,023 | B2 | 10/2010 | Salutzki | |
| 8,613,126 | B2 | 12/2013 | Blockley | |
| 8,732,904 | B2 | 5/2014 | Busch | |
| 9,556,659 | B2 | 1/2017 | Fan | |
| 10,370,885 | B1 * | 8/2019 | Kondratuk | E05F 3/12 |
| 2004/0205930 | A1 | 10/2004 | Huang | |
| 2007/0256275 | A1 | 11/2007 | Winkler | |
| 2012/0279013 | A1 * | 11/2012 | Wildforster | F16K 31/0693 16/52 |
| 2019/0360250 | A1 * | 11/2019 | Kondratuk | E05F 3/102 |
| 2019/0360251 | A1 * | 11/2019 | Kondratuk | E05F 3/102 |

* cited by examiner

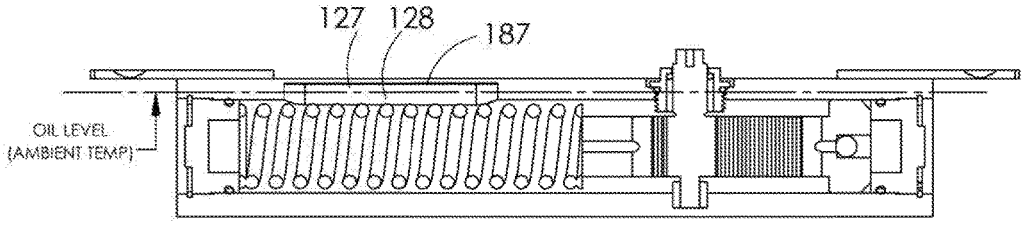
Fig. 22
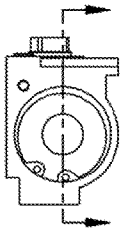
Fig. 21
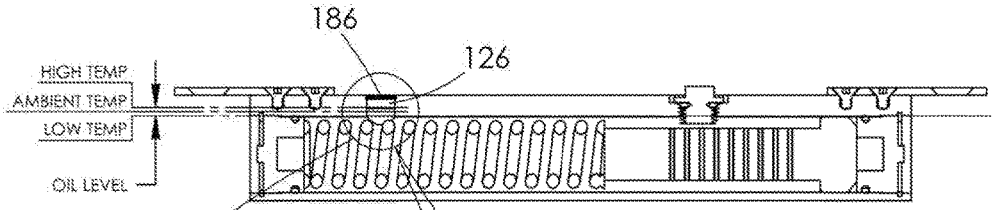
Fig. 24
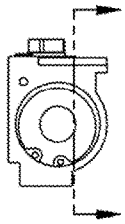
Fig. 23
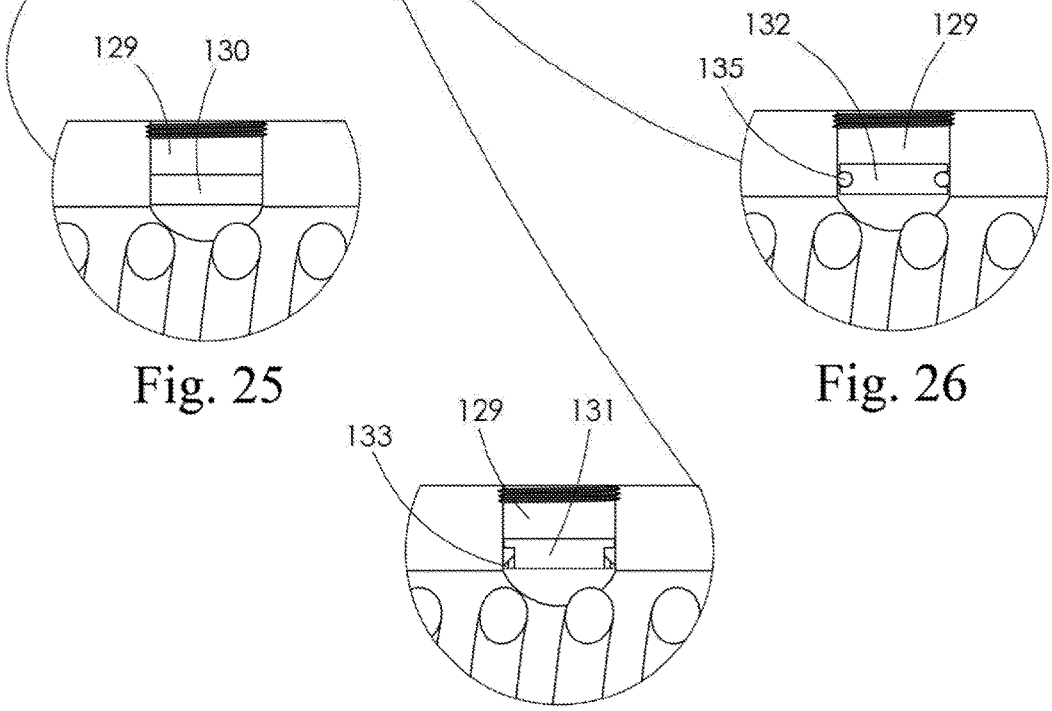
Fig. 25
Fig. 26
Fig. 27

HYDRAULIC DOOR CLOSER WITH FLUID OVERFLOW CHAMBER

RELATED APPLICATION

This application is a continuation-in-part of U.S. Non-provisional application Ser. No. 15/392,070 filed Dec. 28, 2016 and claims priority to U.S. Provisional Patent Application No. 62/273,759 filed Dec. 31, 2015.

FIELD AND BACKGROUND OF THE INVENTION

Storm and screen doors present unique operating parameters for hydraulic door closer product specifications. For example, the temperature range that the closer must operate within is greater than, for example, an internal prime door closer because of the exposure to varying high and low outside temperatures as well as the potential heat buildup between the prime door and the storm or screen door. The heat buildup can be quite substantial and causes the increase in temperature and associated expansion of the hydraulic fluid or hydraulic oil, which subsequently results in a fluid pressure increase in the sealed closer containing the fluid or oil. The increased pressure typically results in fluid or oil leakage due to the intense pressure of the heated fluid.

SUMMARY

The present disclosure describes a pressure control overflow chamber for a rotational hydraulic door closer. This disclosure describes a closer having reduced pressures at high operating temperatures, provides means to maintain required operating fluid or oil levels at low temperatures, and ensures proper closer performance under both extreme high and low temperature conditions.

In one embodiment, the hydraulic door closer comprises a fluid overflow chamber adapted to hold sufficient fluid when the fluid is in both an expanded and contracted state.

In another embodiment, the hydraulic door closer comprises a fluid chamber having a predetermined volume sufficient to hold an expanded fluid at an elevated temperature.

In still another embodiment, the hydraulic door closer comprises an amount of fluid maintained in an overflow chamber so when the fluid contracts there is sufficient fluid in the closer.

In some embodiments, the fluid overflow chamber is a vertical chamber. In other embodiments, the fluid chamber is a horizontal chamber, or is an angled chamber. In other embodiments, the fluid overflow chamber is a vertical or an angled chamber such that an overflow chamber piston operates by gravity. In still other embodiments, the fluid overflow chamber is located in the closer housing surrounding the hydraulic fluid, or is located within the hydraulic fluid itself.

In still another embodiment, the hydraulic door closer comprises a housing filled with fluid and fitted with i) a biasing spring such as, for example a compression spring, attached to a piston having geared teeth and a check valve, ii) a geared pinion, iii) speed control chamber, and iv) an overflow chamber adapted to hold sufficient fluid in both an expanded and contracted state. This embodiment may further comprise a speed control valve as well as horizontal and vertical speed control chamber plugs. This embodiment may also comprise an overflow chamber check valve or screw plug.

In still another embodiment, the hydraulic door closer comprises a housing filled with fluid and fitted with i) a biasing spring such as, for example a compression spring, attached to a piston having geared teeth and a check valve, ii) a geared pinion, iii) speed control chamber, and iv) an overflow chamber adapted to hold sufficient fluid in both an expanded and contracted state. This embodiment may further comprise a speed control valve as well as horizontal and vertical speed control chamber plugs. This embodiment may also comprise an overflow chamber check valve or screw plug. This embodiment may further comprise a closely-fitting overflow chamber piston within a fluid-filled overflow chamber. In some embodiments the overflow chamber piston closely fitted to the hydraulic fluid overflow chamber creates a fluid tight seal that substantially prevents one or more fluids from bypassing the overflow chamber piston. In some embodiments the fluid-filled overflow chamber provides a biasing compression force on the overflow chamber piston when a compressive fluid within a sealed compression chamber of the overflow chamber is compressed when the overflow chamber enters the expanded state. In other embodiments, the closely-fitting overflow chamber piston can be used in conjunction with a biasing spring instead of the biasing compression force. In yet still further embodiments, the overflow chamber piston can be composed of multiple portions where the multiple portions have differing durometers. In yet other embodiments, the overflow chamber piston can include a separate seal portion. As used in any embodiments herein, the overflow chamber can be an overflow chamber cylinder or any other suitable shape or configuration.

In still yet another embodiment, the hydraulic door closer comprises a housing filled with fluid and fitted with i) a biasing spring such as, for example a compression spring, attached to a piston having geared teeth and a check valve, ii) a geared pinion, iii) speed control chamber, and iv) an overflow chamber adapted to hold sufficient fluid in both an expanded and contracted state. This embodiment may further comprise a gravity operated overflow chamber piston within an at least partially vertical overflow chamber, such that the overflow chamber provides a gravity-based biasing compression force on the overflow chamber piston when the overflow chamber enters the expanded state.

DESCRIPTION OF THE DRAWINGS

FIG. 21 is a side view of the closer defining the cross section for FIG. 22.

FIG. 22 is a cross-sectional front view of the closer as defined by FIG. 21, which shows a static overflow chamber in a vertical orientation above a biasing spring.

FIG. 23 is a side view of the closer defining the cross section for FIG. 24.

FIG. 24 is a cross-sectional front view of the closer as defined by FIG. 23, which shows a gravity-operated overflow chamber in a vertical orientation above a biasing spring.

FIG. 25 is a more detailed view of an example of the gravity operated overflow chamber piston of FIG. 24, where the gravity-operated piston is closely fitted to the overflow chamber.

FIG. 26 is a more detailed view of another example of the gravity operated overflow chamber piston of FIG. 24, where the gravity-operated piston includes a piston seal.

FIG. 27 is a more detailed view of yet another example of the gravity operated overflow chamber piston of FIG. 24, where the gravity-operated piston is a multi-durometer piston with a seal component of a second durometer that is integral to the gravity-operated piston.

Figure 1:
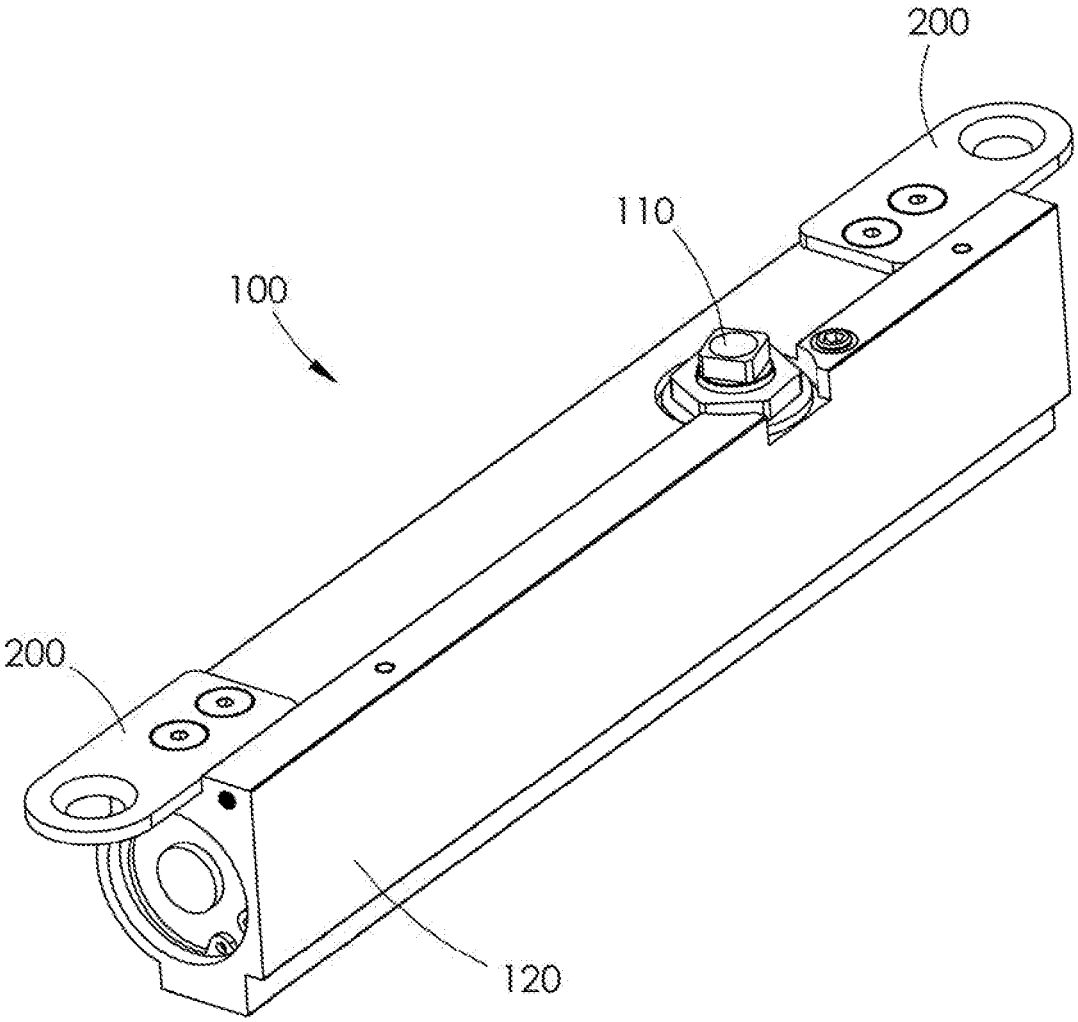
FIG. 1 is an isometric view of a rotational hydraulic closer.

In the listed figures, the described components have the reference numerals set out in the following table:

| Component | Feature | Description |
|---|---|---|
| 100 | | Rotational Hydraulic Closer |
| 110 | | Pinion |
| | 112 | Pinion gear teeth |
| 120 | | Housing |
| | 121 | Overflow connecting chamber |
| | 123 | Horizontal overflow chamber |
| | 124 | Vertical overflow chamber |
| | 125 | Angular overflow chamber |
| | 126 | Gravity-operated overflow chamber |
| | 127 | Static overflow chamber |
| | 128 | Overflow chamber internal volume |
| | 129 | Overflow chamber |
| | 130 | Gravity-operated piston |
| | 131 | Gravity-operated piston |
| | 132 | Gravity-operated piston |
| | 133 | Sealing portion |
| | 135 | Seal |
| 140 | | Overflow chamber vertical plug |
| 183 | | Horizontal overflow chamber screw plug |
| 184 | | Vertical overflow chamber screw plug |
| 185 | | Angular overflow chamber screw plug |
| 186 | | Overflow chamber screw plug |
| 187 | | Overflow chamber top |
| 190 | | Closer piston |
| | 192 | Piston gear teeth |
| | 193 | Piston Seal |
| | 194 | Sealing portion of closer piston |
| 200 | | Mounting tab |
| 210 | | Biasing spring |
| 220 | | Valve, speed control |
| 225 | | Speed control device |
| 226 | | Speed control device |
| 230 | | Pressurized side of piston |
| 240 | | Unpressurized side of piston |
| 250 | | Speed control chamber |
| 260 | | Vertical speed control chamber plug |
| 270 | | Horizontal speed control chamber plug |
| 280 | | Overflow chamber piston |
| 281 | | Overflow chamber piston seal |
| 282 | | Overflow chamber spring |
| | 323 | Horizontal overflow chamber |
| 380 | | Overflow chamber piston |
| 382 | | Overflow chamber spring |
| | 423 | Horizontal overflow chamber |
| 480 | | Overflow chamber piston |
| 482 | | Overflow chamber compressible fluid |
| | 523 | Horizontal overflow chamber |
| 580 | | First portion of overflow chamber piston |
| 581 | | Second portion of overflow chamber piston |
| 582 | | Overflow chamber spring |
| | 623 | Horizontal overflow chamber |
| 680 | | Overflow chamber piston |
| 681 | | Overflow chamber piston sealing portion |
| 682 | | Overflow chamber compressible fluid |

DETAILED DESCRIPTION OF THE INVENTION

The disclosed hydraulic door closer having an overflow chamber or reservoir is particularly intended for use in a hydraulic door closer for a storm or screen door, but may provide useful benefits in other closer applications that are subject to a wide range of temperatures.

The incorporation of the overflow chamber or reservoir within the closer allows a space for hydraulic fluid to expand in high temperature situations which controls or tempers the pressure build up and eliminates the hydraulic fluid leakage condition associated with high internal fluid pressures. It may be desirable to incorporate a small one way check valve in the overflow chamber, which will work to reduce or eliminate any back pressure in the closer as the temperature and pressure change during use. This also serves as a means to allow the overflow chamber to be open to ambient air pressure.

Hydraulic fluid and hydraulic oil are terms that are sometimes used interchangeably, but they are not necessarily the same. Although hydraulic oil is a fluid, hydraulic fluid can include other fluids besides just oil, such as water, water-oil emulsions, salt solutions, and the like. However, embodiments of the present disclosure are contemplated as employing the more general term hydraulic fluid, which is generally referred to as "oil" or "fluid" in this specification. Embodiments of the present disclosure are not meant to be limited to hydraulic oil only, but to any suitable hydraulic fluid or fluids.

In addition to the expansion due to high temperature, the overflow or expansion chamber may also provide a benefit in cold temperatures by maintaining a prescribed oil volume such that the fluid level never becomes too low during cold temperature and fluid contraction resulting from the cold temperature. This is accomplished by having an oil amount maintained in the overflow chamber so when the oil contracts, there is sufficient fluid volume in the closer at the predetermined low temperature requirement.

With the incorporation of the overflow expansion chamber, the oil pressure and oil level is maintained to a pressure which prevents leakage and provides a consistent oil operating level ensuring proper closer performance at the temperature extremes experienced by storm and screen doors.

Referring to FIG. 1, the generalized configuration of a rotationally activated hydraulic door closer (100) is illustrated. In the assembled state, the door closer is comprised of a housing (120), a pinion (110) in which an arm (not shown) is typically attached to transfer angular torque from the closer to the door, and mounting tab(s) (200) to affix the closer to the door or a door frame. According to various embodiments, the door closer can include various alternative arrangements and configurations. In particular, alternative door closer arrangements and configurations, including those disclosed in U.S. Pat. Nos. 4,847,946, 5,337,448, and 5,850,671 are hereby incorporated by reference herein for all purposes.

Figure 2:
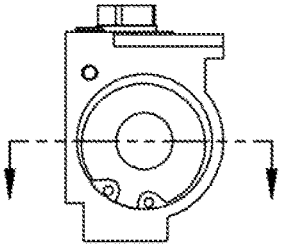
FIG. 2 is a side view of the closer defining the cross section for FIG. 3A.
Figure 3A:
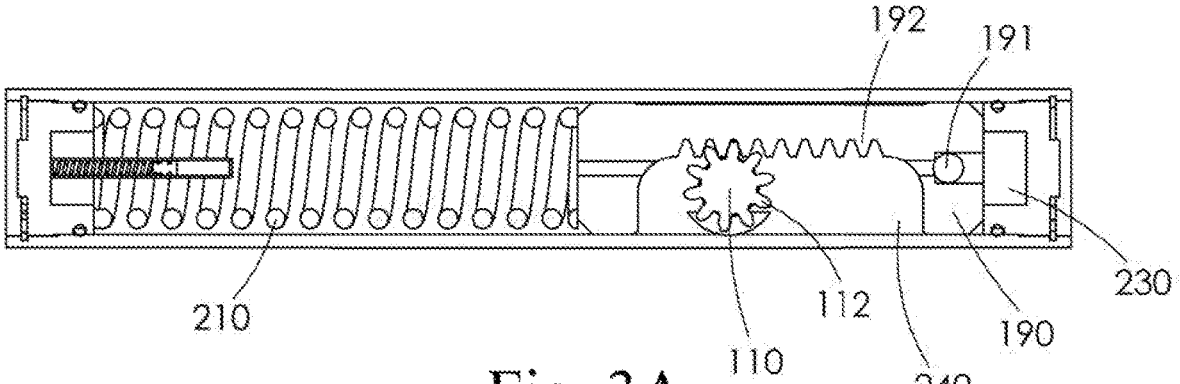
FIG. 3A is a cross-sectional top view of the closer as defined by FIG. 2.

Referring to FIG. 3A which is a cross-sectional top view of the closer as defined by FIG. 2, there is a biasing spring (210), a piston (190) with check valve (191), and a pinion (110). Also within the closer is hydraulic fluid, typically a hydraulic oil or oil derivative, which is used to dampen the speed of the closer. As the piston moves transversely within the closer body, the pinion (110) rotates as a result of the engagement between the teeth (192) of the piston and the teeth (112) of the pinion, causing the closer arm (not shown) to rotate and pull the door closed. When a closer arm (not shown) is attached to the pinion and rotated as the door is opened, the pinion gear teeth (112) apply a force to the piston gear teeth (192) to move the piston (190) in a direction that further compresses the spring and causing oil to flow from the unpressurized side of the piston through one-way check valve (191) to the pressurized side of the piston. When the door is released to close, the biasing spring urges the piston toward the pressurized side of the piston (230). Oil on the pressurized side of the closer is displaced but is prevented from flowing back through the check valve so that oil flows through the speed control chamber (not shown), and speed control valve (not shown) to the unpressurized side of the piston (240).

Figures 3B, 3C:
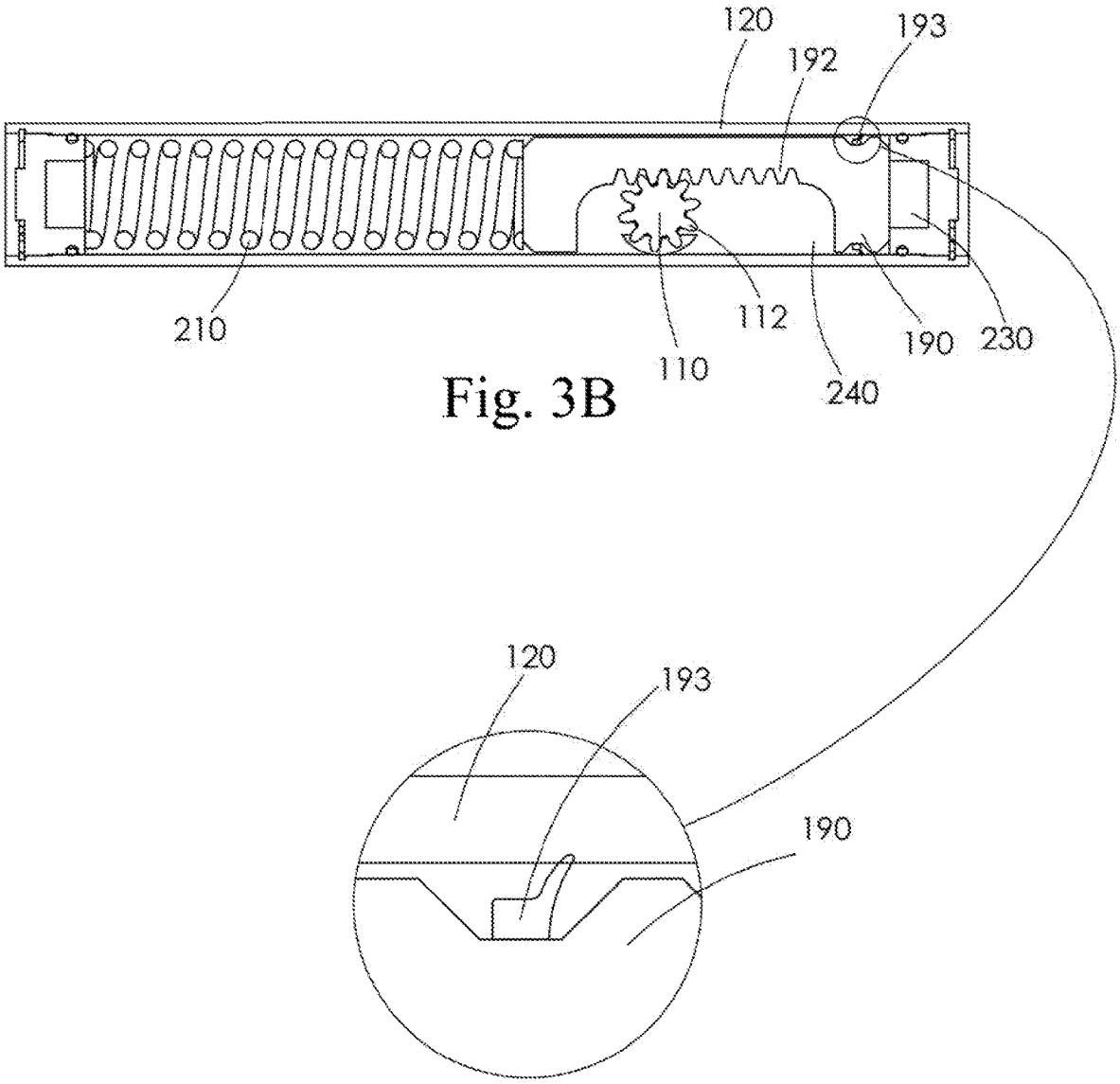
FIG. 3B is a cross-sectional top view of an alternative embodiment of the closer as defined by FIG. 2.
FIG. 3C is a cross-sectional top close up view of the alternative embodiment as defined by FIG. 3B.

FIG. 3B depicts an alternate embodiment similar to the embodiment shown in FIG. 3A, but in which a piston seal (193) also functions as a check valve. In the embodiment shown in FIG. 3B, the piston seal (193) comprises a sealing region that creates a fluid-tight seal between the piston (190) and the inner wall of the housing (120) when the pressure on the pressurized side of the piston (230) exceeds the pressure of the unpressurized side of the piston (240). When the door is opened, the pinion gear teeth (112) apply a force to the piston gear teeth (192) to move the piston (190) in a direction that further compresses the spring and displaces the oil from unpressurized side of the piston around the sides of the piston and past the piston seal (193) to the pressurized side of the piston. When the door is released to close, the biasing spring urges the piston toward the pressurized side of the piston (230). Oil on the pressurized side of the closer is displaced but is prevented from flowing past the piston seal (193) so that oil flows through the speed control chamber (not shown), and speed control valve (not shown) to the unpressurized side of the piston (240).

Figure 4:
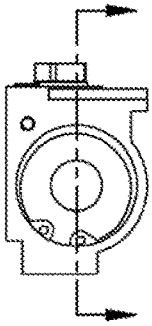
FIG. 4 is a side view of the closer defining the cross section for FIG. 5.
Figure 5:
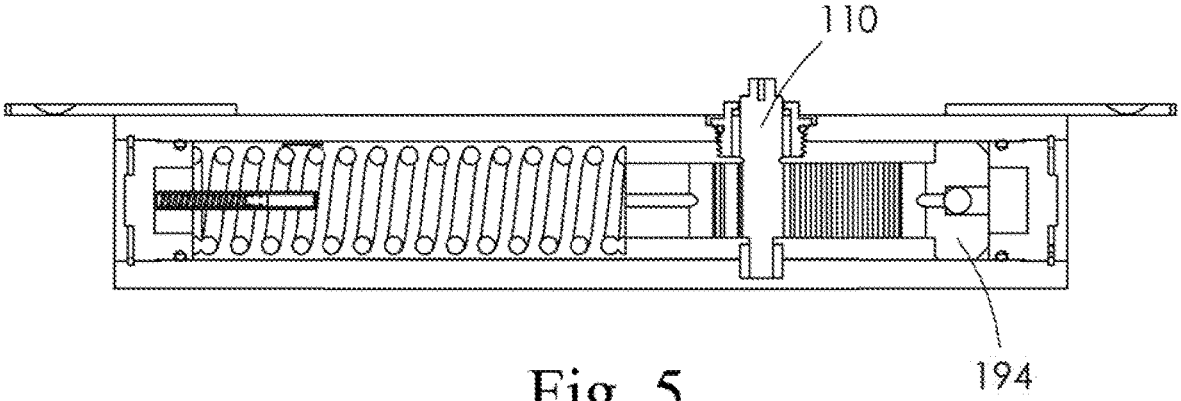
FIG. 5 is a cross-sectional front view of the closer as defined by FIG. 4.
Figure 6:
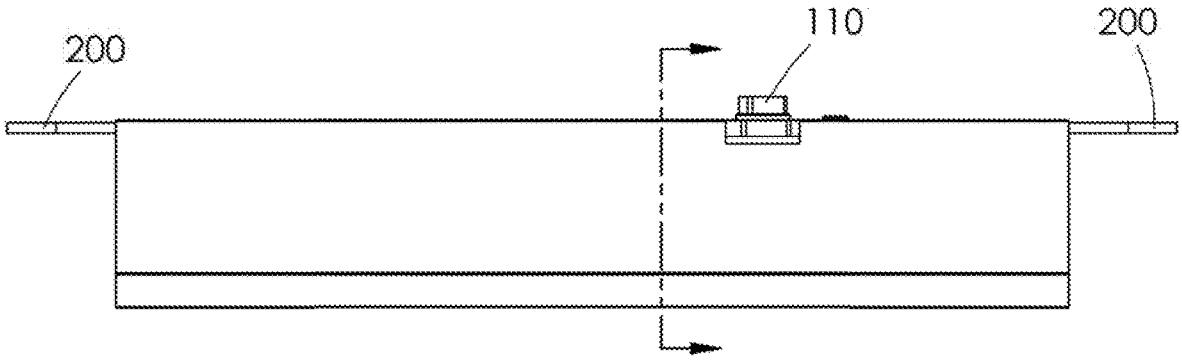
FIG. 6 is a front view of the closer defining the cross section for FIG. 7.
Figure 7:
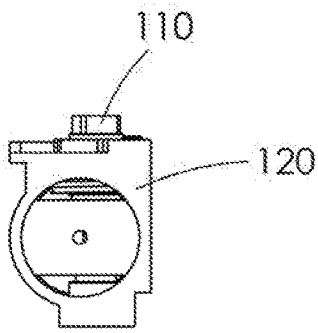
FIG. 7 is a cross-sectional side view of the closer as defined by FIG. 6.

FIG. 3C is a cross-sectional top close up view of the alternative embodiment as defined by FIG. 3B. Additional cross-sectional, front and side views of the closer of FIG. 3A are illustrated in FIGS. 4-7. FIG. 5 is a cross-section front view of the closer as defined by FIG. 4 illustrating pinion (110) and the sealing portion of closer piston (194). FIG. 6 is a front view of the closer defining the cross section for FIG. 7 and illustrates pinion (110) and mounting tabs (200). FIG. 7 is a cross section defined by FIG. 6 and illustrates pinion (110) and housing (120).

Figure 9A:
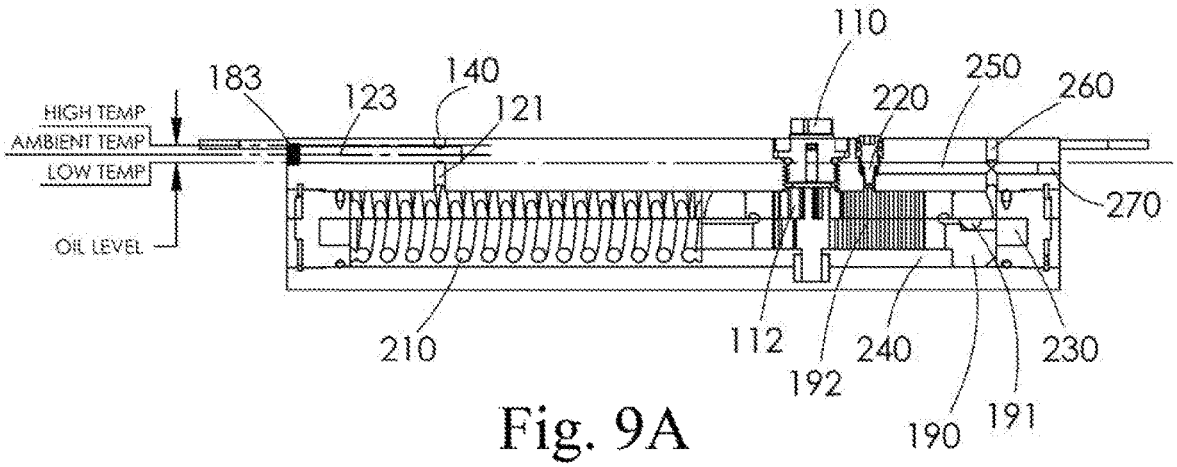
FIG. 9A is a cross-sectional front view of the closer as defined by FIG. 8, which shows an overflow chamber in a horizontal orientation.

Referring to FIG. 9A, chamber (123) is an overflow chamber with horizontal overflow chamber screw plug (183) and overflow chamber vertical plug (140) for an embodiment which relies on fluid dynamics to allow fluid (oil) volume fluctuation based upon temperature changes. The chamber in this embodiment is oriented horizontally, and via an overflow connecting chamber (121) permits the expansion and contraction of oil volume based upon temperature changes while maintaining an overall internal oil level and pressure that allows the closer to operate normally. By allowing the internal oil to expand and contract in the overflow chamber as temperature increases and decreases, the oil pressure is maintained at a limited and/or consistent pressure preventing the oil leaks previously described. Furthermore, sizing and locating the overflow chamber properly ensures the oil level remains at the level necessary to ensure normal operation of the closer at all temperatures. That is, even when the oil contracts and the oil level drops to the low temperature line as depicted in FIG. 9A, there is still sufficient oil within the closer to allow the closer to operate normally.

In FIG. 9A, the oil is typically regulated by a speed control valve (220), to control the flow of oil from the pressurized side of the piston (230) to the unpressurized side (240) of the piston. The biasing spring in this embodiment is under compression when assembled within the closer. The spring exerts a biasing load on the piston, which is in the neutral state as illustrated, and is balanced within the housing resulting in no torque at the pinion. When a closer arm (not shown) is attached to the pinion (110) and rotated as the door is opened, the pinion gear teeth (112) apply a force to the piston gear teeth (192) to move the piston (190) in a direction that further compresses the spring and causing oil to flow from the unpressurized side of the piston through one-way check valve (191) to the pressurized side of the piston. When the door is released to close, the biasing spring urges the piston toward the pressurized side of the piston (230). Oil on the pressurized side of the closer is displaced and flows through the speed control chamber (250), and valve (220) to the unpressurized side of the piston (240).

Figure 8:
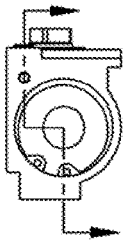
FIG. 8 is a side view of the closer defining the cross section for FIG. 9A.
Figure 9B:
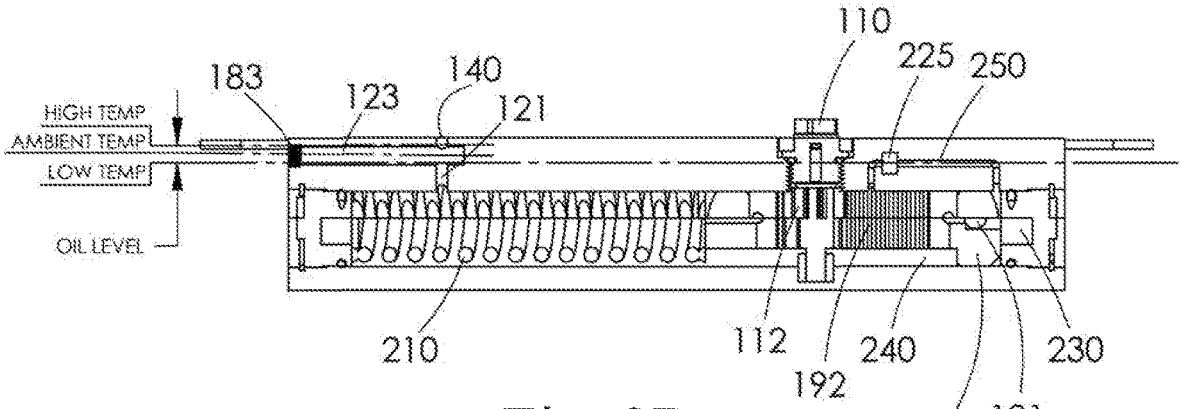
FIG. 9B is a cross-sectional front view of an alternate embodiment of the closer as defined by FIG. 8, in which the flow of oil from the pressurized side of the piston to the unpressurized side of the piston is regulated by an alternate type of device.

FIG. 9B is a cross-sectional front view of an alternate embodiment of the closer as defined by FIG. 8, in which the flow of oil from the pressurized side of the piston to the unpressurized side of the piston is regulated by an alternate type of device. In the alternate embodiment shown in FIG. 9B, the oil may be regulated by another type of device (225) to control the flow of oil from the pressurized side of the piston (230) to the unpressurized side (240) of the piston. Such speed control devices (225) may include a membrane comprising perforations of a particular size, a filter or screen comprising a mesh with a particular open area, an orifice of a particular diameter, or other similar device known to one skilled in the art. The biasing spring in this embodiment is under compression when assembled within the closer. The spring exerts a biasing load on the piston, which is in the neutral state as illustrated, and is balanced within the housing resulting in no torque at the pinion. When a closer arm (not shown) is attached to the pinion (110) and rotated as the door is opened, the pinion gear teeth (112) apply a force to the piston gear teeth (192) to move the piston (190) in a direction that further compresses the spring and causing oil to flow from the unpressurized side of the piston through one-way check valve (191) to the pressurized side of the piston. When the door is released to close, the biasing spring urges the piston toward the pressurized side of the piston (230). Oil on the pressurized side of the closer is displaced and flows at a controlled speed through the speed control chamber (250) and speed control device (225) to the unpressurized side of the piston (240).

Figure 9C:
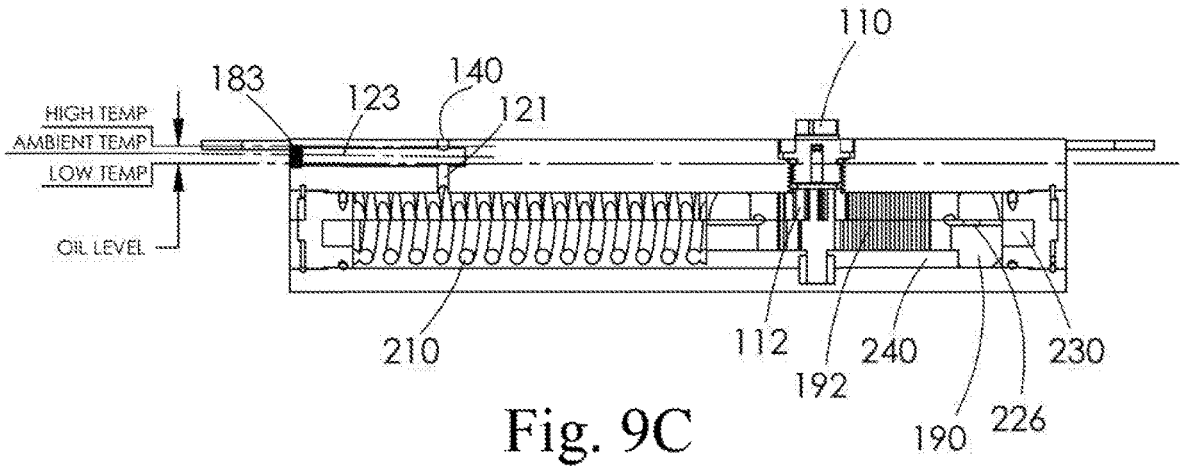
FIG. 9C is a cross-sectional front view of the another alternate embodiment of the closer as defined by FIG. 8, where the oil is regulated by a speed control device located in the piston to control the flow of oil from the pressurized side of the piston through the piston to the unpressurized side of the piston.
Figure 10:
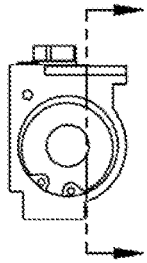
FIG. 10 is a side view of the closer defining the cross section for FIG. 11.

FIG. 9C is a cross-sectional front view of the another alternate embodiment of the closer as defined by FIG. 8, where the oil is regulated by a speed control device located in the piston to control the flow of oil from the pressurized side of the piston through the piston to the unpressurized side of the piston. In the other alternate embodiment shown in FIG. 9C, the oil may be regulated by a speed control device (226) located in piston (190) to control the flow of oil from the pressurized side of the piston (230) through the piston (190) to the unpressurized side (240) of the piston. Such speed control devices (226) may include a membrane comprising perforations of a particular size, a filter or screen comprising a mesh with a particular open area, an orifice of a particular diameter, or other similar device known to one skilled in the art. The biasing spring in this embodiment is under compression when assembled within the closer. The spring exerts a biasing load on the piston, which is in the neutral state as illustrated, and is balanced within the housing resulting in no torque at the pinion. When a closer arm (not shown) is attached to the pinion (110) and rotated as the door is opened, the pinion gear teeth (112) apply a force to the piston gear teeth (192) to move the piston (190) in a direction that further compresses the spring and causing oil to flow from the unpressurized side of the piston through the speed control device (226) to the pressurized side of the piston. When the door is released to close, the biasing spring urges the piston toward the pressurized side of the piston (230). Oil on the pressurized side of the closer is displaced and flows at a controlled speed through the speed control device (226) to the unpressurized side of the piston (240).

Figure 11:
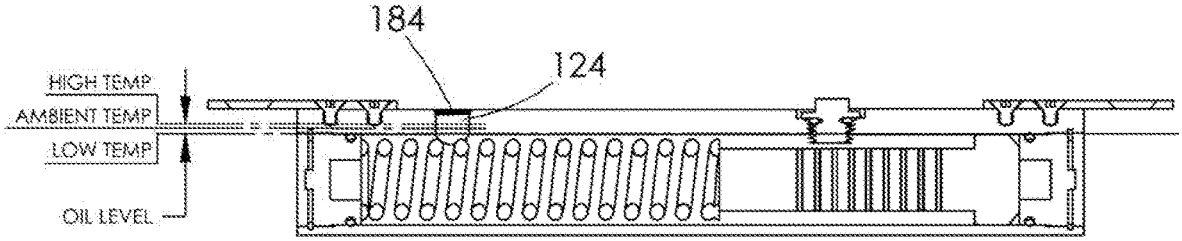
FIG. 11 is a cross-sectional front view of the closer as defined by FIG. 10, which shows an overflow chamber in a vertical orientation.
Figure 12:
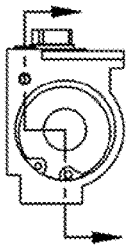
FIG. 12 is a side view of the closer defining the cross section for FIG. 13.

Referring to FIG. 11, chamber (124) is an overflow chamber with vertical overflow chamber screw plug (184) for an alternate embodiment which relies on fluid dynamics to allow fluid (oil) volume fluctuation based upon temperature changes. The chamber in this embodiment is oriented vertically, and permits the expansion and contraction of oil volume based upon temperature changes while maintaining an overall internal oil level and pressure that allows the closer to operate normally. As with the horizontal chamber, the oil pressure and level is maintained at levels that ensure normal operation of the closer at all temperatures.

Figure 13:
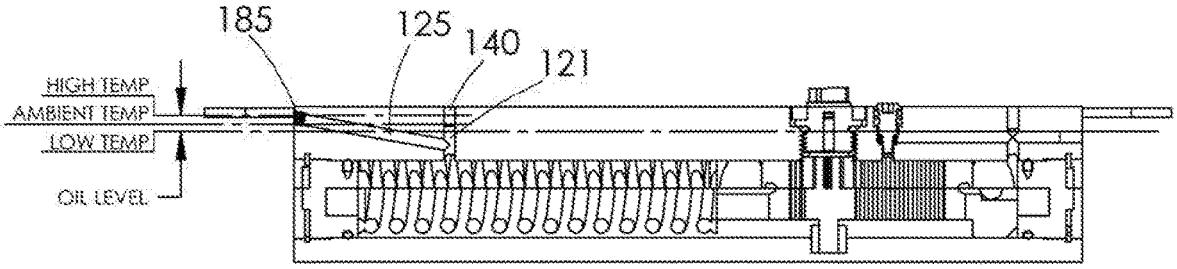
FIG. 13 is a cross-sectional front view of the closer as defined by FIG. 12, which shows an overflow chamber in an angular orientation.

Referring to FIG. 13, chamber (125) is an active overflow chamber with angular overflow chamber screw plug (185) for yet another embodiment that relies on fluid dynamics to allow fluid (oil) volume fluctuation based upon temperature changes. The chamber in this embodiment is oriented at an angle, and permits the expansion and contraction of oil volume based upon temperature changes while maintaining an overall internal oil level and pressure that allows the closer to operate normally. As with the horizontal and vertical chambers, the oil pressure and level is maintained at levels that ensure normal operation of the closer at all temperatures.

Figure 14:
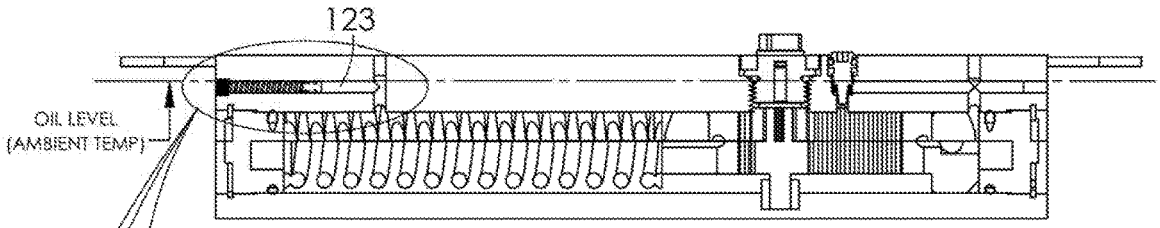
FIGS. 14, 14A, 14B and 14C illustrate a horizontal fluid chamber containing an overflow chamber piston, overflow chamber piston seal, and overflow chamber spring.
Figure 14A:
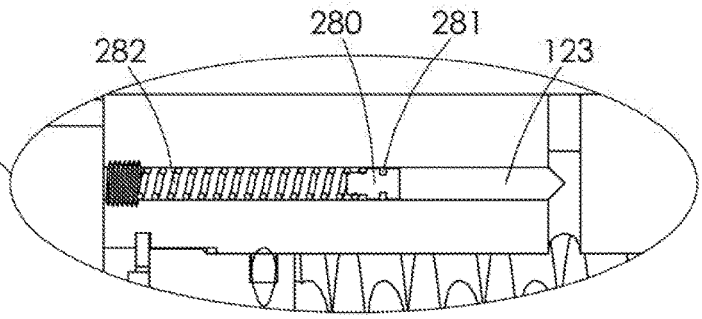
Figure 14B:
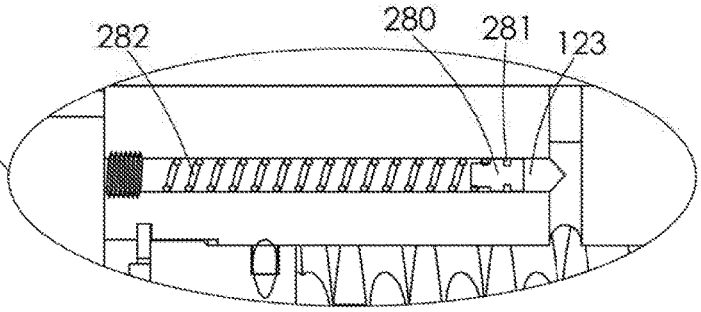
Figure 14C:
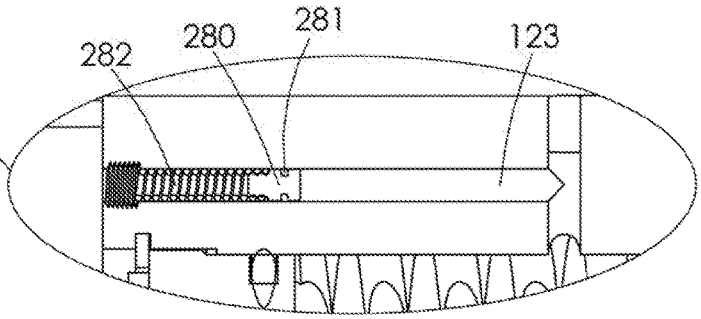
Figure 15:
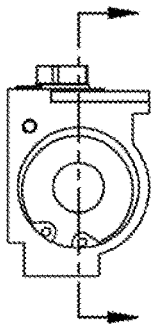
FIG. 15 is a side view of the closer defining the cross section for FIG. 16.

FIG. 14 illustrates another embodiment having a spring-biased piston in the overflow chamber. The addition of a spring-biased piston in the overflow chamber further enhances the operational performance of the closer. In the horizontally-oriented chamber depicted in FIG. 14, for example, overflow chamber (123) contains a piston (280) backed by a spring (282) and carrying a piston seal (281). The piston would be located at an intermediate position within the overflow chamber at an ambient (room temperature) state. This intermediate position is illustrated in FIG. 14A showing an enlargement of the overflow chamber components of FIG. 14. In a low temperature state, the oil within the closer would contract due to a decrease in temperature. This would decrease the volume of the oil and the spring-biased overflow chamber piston would move in a direction decreasing the volume within the overflow chamber, but yet maintaining an overall internal oil level and pressure within the closer allowing the closer to operate normally. This low temperature configuration of the overflow components is illustrated in FIG. 14B. Alternately, in a high temperature state, the oil within the closer would expand due to an increase in temperature. This would increase the volume of the oil and the overflow chamber piston would move in a direction increasing the volume within the overflow chamber, but yet maintaining an overall internal oil level and pressure within the closer allowing the closer to operate normally. This high temperature configuration of the overflow chamber components is illustrated in FIG. 14C. The spring (282) that biases the piston must be carefully sized such that throughout the entire operating temperature range of the closer, the expanding oil can overcome the spring force and increase the effective volume of the overflow chamber as the oil temperature increases; yet while the oil temperature decreases and the oil contracts, the spring force can overcome the force of friction between the piston seal and overflow chamber thereby allowing the spring to extend and reduce the effective volume of the overflow chamber.

Figure 16:
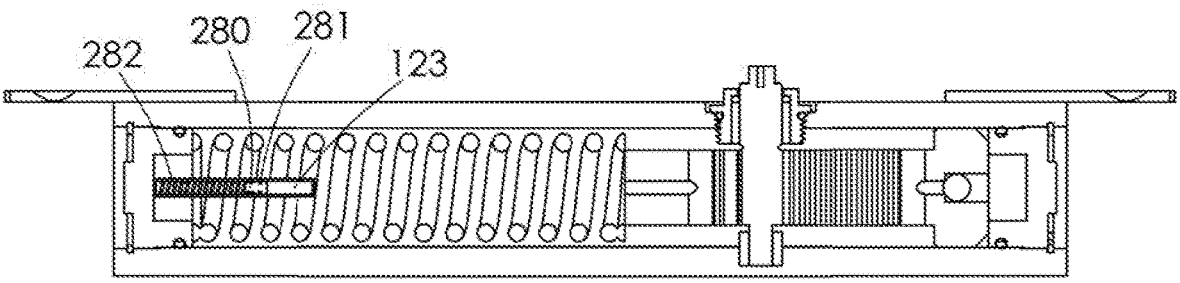
FIG. 16 is a cross-sectional front view of the closer as defined by FIG. 15 which shows an overflow chamber in a horizontal orientation in the interior region of the closer defined by the biasing spring.

Referring to FIG. 16, chamber (123) is a horizontal overflow chamber with horizontal overflow chamber having a spring-biased piston (280) in the overflow chamber. The chamber in this embodiment is located in an interior region of the closer defined by the inside diameter of the biasing spring and permits the expansion and contraction of oil volume based upon the positions of the overflow chamber piston (280) with related overflow chamber piston seal (281) and overflow chamber spring (282) in the overflow chamber to maintain an overall internal oil level and pressure that allows the closer to operate normally at all temperatures. By allowing the internal oil to expand and contract in the overflow chamber as temperature increases and decreases, the oil pressure is maintained at essentially the same pressure as at ambient temperatures, and prevents the oil leaks previously described.

Figure 17:
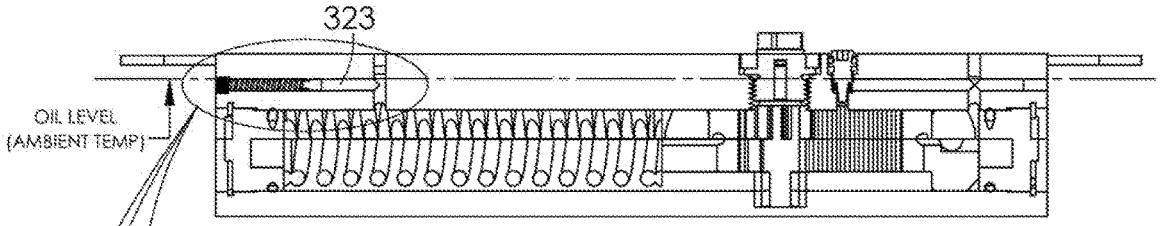
FIGS. 17, 17A, 17B and 17C illustrate a horizontal fluid chamber containing a closely fitted overflow chamber piston, and overflow chamber spring.
Figure 17A:
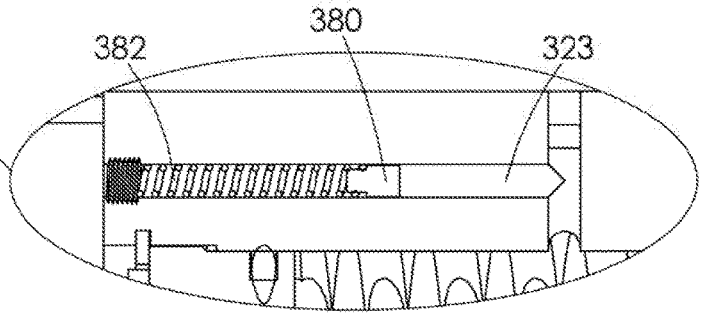
Figure 17B:
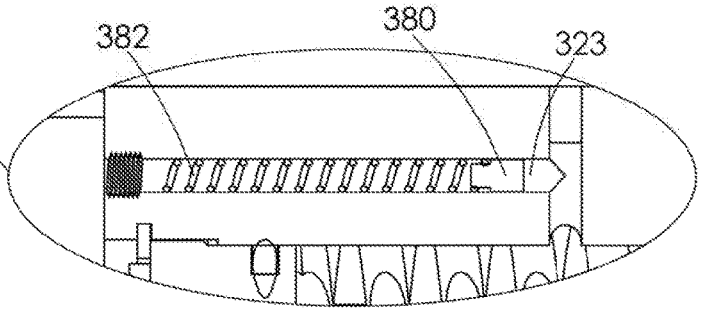
Figure 17C:
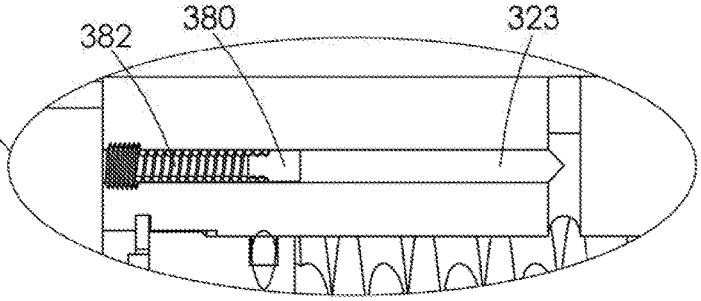

Referring to FIG. 17, another embodiment related to FIG. 14 is illustrated, but instead of having a piston seal to create a fluid-tight seal within the piston in the overflow chamber, FIG. 17 includes a close fitted overflow chamber piston (380) within a horizontal overflow chamber (323 Therefore, according to FIG. 17, no piston seal is required due to close machining tolerance of the components. As in FIG. 14, a spring biases the overflow chamber piston (380) as the volume and pressure of the oil increase and decrease with changes in the operating temperature of the closer. In the horizontally-oriented chamber depicted in FIG. 17, for example, overflow chamber (323) contains a piston (380) backed by a spring (382)). As in FIG. 14B, a low temperature configuration of the overflow components is illustrated in FIG. 17B. Also as in FIG. 14C, a high temperature configuration of the overflow chamber components is illustrated in FIG. 17C. Also as in FIG. 14, the spring (382) that biases the piston must be carefully sized such that throughout the entire operating temperature range of the closer, the expanding oil can overcome the spring force and increase the effective volume of the overflow chamber as the oil temperature increases; yet while the oil temperature decreases and the oil contracts, the spring force can overcome the force of friction between the overflow chamber piston and overflow chamber thereby allowing the spring to extend and reduce the effective volume of the overflow chamber. Operation in FIG. 17 can be substantially similar to that described with respect to FIG. 14, above.

According to a variation of the embodiment shown in FIGS. 17, 17A, 17B, and 17C, the close fitted overflow chamber piston (380) is formed of a single portion of a single durometer of a soft material configured to seal the piston (380) to the overflow chamber (323) with increased tolerance for less precision in the close fitting aspect. In some embodiments that employ the chamber piston (380) being formed of the single portion of the single durometer, increased tolerance for less precision in the close fitting aspect, the chamber piston (380) is not closely fitted to the overflow chamber (323). In some embodiments, the single durometer overflow chamber piston (380) is composed of a substantially soft material that provides increased tolerance with respect to the single durometer overflow chamber piston (380) and the overflow chamber (323) as the single durometer overflow chamber piston contacts and slides within the overflow chamber during operation. In other embodiments, the overflow chamber piston (380) creates a fluid tight seal that substantially prevents one or more fluids from bypassing the overflow chamber piston (380).

Figure 18:
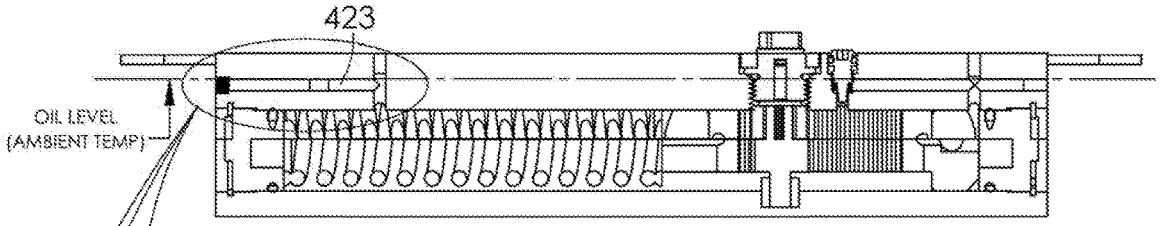
FIGS. 18, 18A, 18B and 18C illustrate a horizontal fluid chamber containing a closely fitted overflow chamber piston.
Figure 18A:
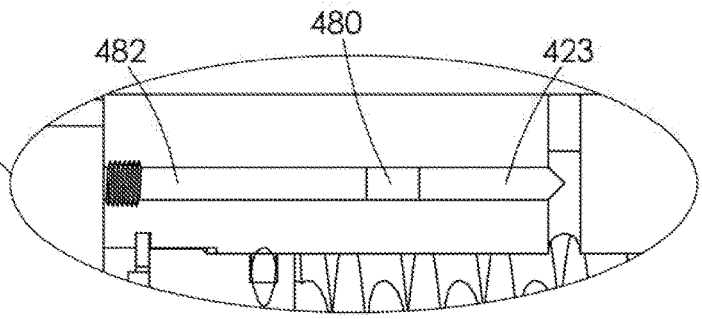
Figure 18B:
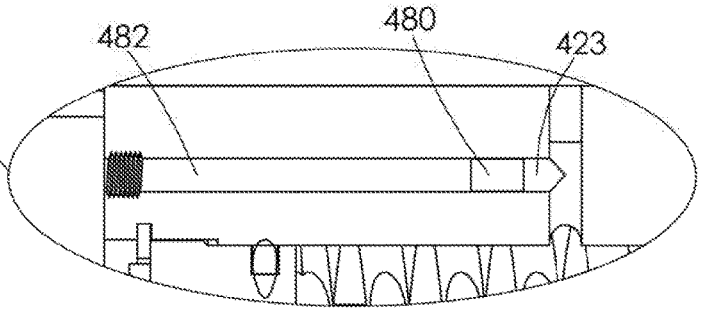
Figure 18C:
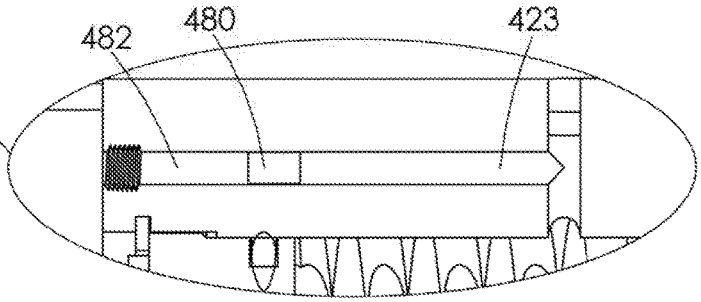

Referring to FIG. 18, another embodiment related to FIGS. 14 and 17 is illustrated, but instead of having a piston seal to create a fluid-tight seal between the piston and the overflow chamber and a spring backing the piston, FIG. 18 includes a close fitted overflow chamber piston (480) within a horizontal overflow chamber (423), and also introduces a compressible fluid "air-spring" instead of a coil-based spring, where an overflow chamber compressible fluid (482) within the horizontal overflow chamber is compressed like a spring at higher temperatures or anytime there are greater temperatures present. As used herein, a fluid or a compressible fluid can include liquids, gases, or any combinations or suitable variations thereof. Therefore, according to FIG. 18, no piston seal is required due to close fitment and tolerance of the components, and no biasing coil spring is necessary. Functionally similar to FIG. 14, a compressible fluid (482) (e.g., air or other gas) biases the overflow chamber piston (480) as the volume and pressure of the oil increase and decrease with changes in the operating temperature of the closer. In the horizontally-oriented chamber depicted in FIG. 18, for example, overflow chamber (423) contains a piston (480) backed by the compressible fluid (482). As in FIG. 14B, a low temperature configuration of the overflow components is illustrated in FIG. 18B. Also as in FIG. 14C, a high temperature configuration of the overflow chamber components is illustrated in FIG. 18C. Also as in FIG. 14, the compressible fluid (482) that biases the piston must be carefully volumetrically sized, selected and caused to fill the horizontal overflow chamber (423) such that throughout the entire operating temperature range of the closer, the expanding oil can overcome the fluid compression force and increase the effective volume of the overflow chamber as the oil temperature increases; yet while the oil temperature decreases and the oil contracts, the fluid compression force can overcome the force of friction between the overflow chamber piston and overflow chamber thereby allowing the compressible fluid to expand and reduce the effective volume of the overflow chamber. Operation in FIG. 18 can be substantially similar to that described with respect to FIG. 14, above.

According to some embodiments, the hydraulic fluid will balance in pressure with the overflow chamber piston (480). When the fluid expands, the overflow chamber piston will compress the compressible fluid until the force is balanced on the overflow chamber piston. Likewise, when the hydraulic fluid is cooled, the overflow chamber piston will move to balance the pressure on the overflow piston. In such cases, observed variations include the friction of the overflow piston for movement.

According to various embodiments, a deformable material can take the place of a biasing spring or air spring within the fluid overflow chamber. The deformable material can bias the overflow chamber piston. The deformable material can be configured to return to its original shape and size after deformation. The deformable material can also include a material that is shaped or configured so as to impart a deformable characteristic. As used herein, the deformation of the deformable material can include compression, extension, expansion, stretching, bunching, folding, accordion-like compression/folding, or any other type of deformation. The deformable material can be a semi-solid material that can change shape and size depending on forces acting thereon. For example, the deformable material can include a suitable foam or elastomeric material.

According to various embodiments, an overflow chamber piston is biased when a fluid volume changes within a fluid overflow chamber. In some embodiments, the overflow chamber piston is biased at elevated temperatures. In other embodiments, the overflow chamber piston is biased at lower temperatures. The biasing of the overflow chamber piston can be selectively set based on environmental conditions. In some embodiments, the overflow chamber piston can be "reverse" biased. In a reverse biased arrangement, the overflow chamber piston can operate such that at lower temperatures the overflow chamber piston becomes biased. In some embodiments of a reverse or tensile biased arrangement, a tension-based spring or partial/full fluid vacuum can be utilized within the fluid overflow chamber.

In some embodiments, as a fluid within an overflow chamber enters an expanded state, e.g., at elevated temperatures, the overflow chamber piston becomes increasingly biased. Likewise, as the fluid enters a contracted state, e.g., at lower temperatures, the overflow chamber piston becomes decreasingly biased. However, in a reverse biased arrangement the opposite can be true, and lower temperatures can cause the overflow chamber piston to become increasingly biased.

Fluid volume can be affected by ambient (e.g., environmental) temperature. Ambient temperatures and temperature changes can therefore have an effect on the variable volume of fluid within the fluid overflow chamber of a door closer. Therefore, the overflow chamber piston can become more or less biased in response to ambient temperature changes. Various arrangements for biasing the overflow chamber piston are described herein, and include springs, fluid-based biasing, deformable materials, and the like. Biasing the overflow chamber piston can allow the door closer to operate at a wider range of ambient temperatures by allowing a dynamic door closer fluid volume that is sensitive to ambient temperature changes. Within a door closer it can be desirable to maintain a relatively consistent internal fluid pressure for consistent door closing characteristics. Varying the usable volume within the door closer can beneficially improve door closer performance at varying ambient temperatures.

Figure 19:
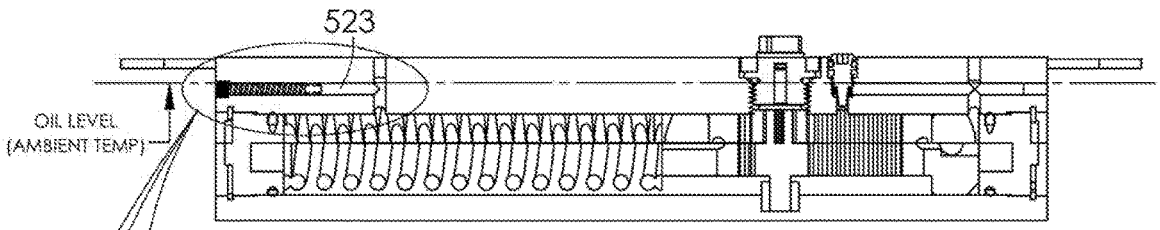
FIGS. 19, 19A, 19B and 19C illustrate a horizontal fluid chamber containing a multi-durometer overflow chamber piston, and overflow chamber spring.

Referring to FIG. 19, another embodiment having a spring-biased piston in the overflow chamber is shown. FIG. 19 introduces an overflow chamber piston having first and second portions, which can be integral, yet have different durometers (e.g., hardness). In the horizontally-oriented chamber depicted in FIG. 19, for example, overflow chamber (523) contains piston with a first portion (580) and a second portion (581), both backed by a spring (582). According to various embodiments, the second portion (581) of the piston can operate as a piston seal, similar to other piston seal embodiments herein. In some embodiments, the second (581), sealing portion of overflow chamber piston is composed of a substantially soft material that provides increased tolerance with respect to the overflow chamber piston and the overflow chamber as the overflow chamber piston contacts and slides within the overflow chamber during operation. In other embodiments, the overflow chamber piston second portion (581) creates a fluid tight seal that substantially prevents one or more fluids from bypassing the overflow chamber piston.

Figure 19A:
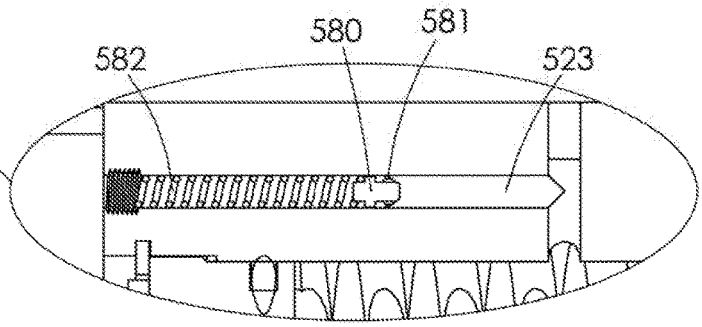
Figure 19B:
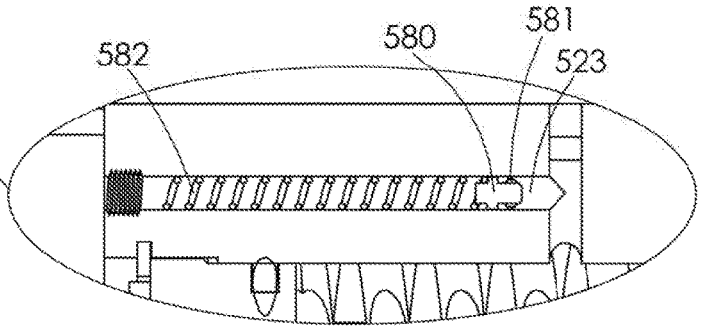
Figure 19C:
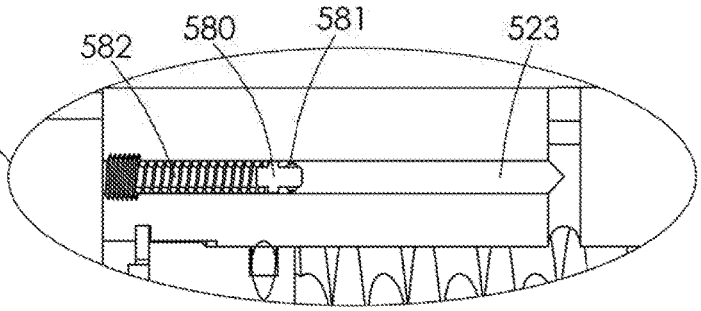

The piston composed of first and second portions (580 and 581) would be located at an intermediate position within the overflow chamber at an ambient (room temperature) state. This intermediate position is illustrated in FIG. 19A showing an enlargement of the overflow chamber components of FIG. 19. In a low temperature state, the oil within the closer would contract due to a decrease in temperature. A low temperature configuration of the overflow components is illustrated in FIG. 19B. A high temperature configuration of the overflow chamber components is illustrated in FIG. 19C. The spring (582) that biases the piston must be carefully sized such that throughout the entire operating temperature range of the closer, the expanding oil can overcome the spring force and increase the effective volume of the overflow chamber as the oil temperature increases; yet while the oil temperature decreases and the oil contracts, the spring force can overcome the force of friction between the piston seal and overflow chamber thereby allowing the spring to extend and reduce the effective volume of the overflow chamber.

Figure 20:
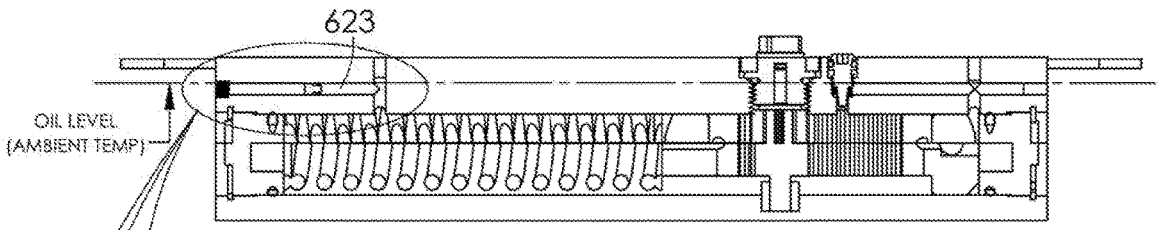
FIGS. 20, 20A, 20B and 20C illustrate a horizontal fluid chamber containing a multi-durometer overflow chamber piston.
Figure 20A:
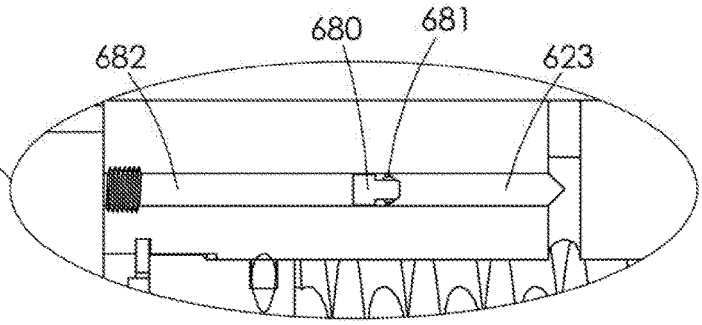
Figure 20B:
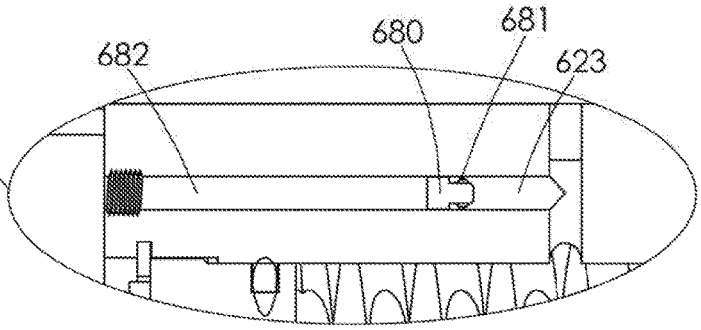
Figure 20C:
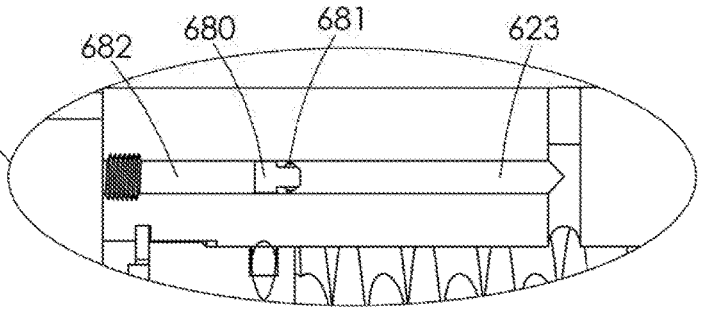

Referring to FIG. 20, another embodiment is shown where the piston is a multi-durometer piston, and where the piston is biased with a compressible fluid (682) acting as an "air spring" in the overflow chamber. In the horizontally-oriented chamber depicted in FIG. 20, for example, overflow chamber (623) contains a piston (680) backed by an overflow chamber compressible fluid (682) and carrying a piston sealing portion (681), which can include a piston seal or a portion of the piston that is a second durometer different than other parts of the piston (680). An ambient (room temperature) state is illustrated in FIG. 20A showing an enlargement of the overflow chamber components of FIG. 20. A low temperature configuration of the overflow components is illustrated in FIG. 20B. A high temperature configuration of the overflow chamber components is illustrated in FIG. 20C. The compressible fluid (682) that biases the piston must be selected to be volumetrically sized such that throughout the entire operating temperature range of the closer, the expanding oil can overcome the compressible fluid biasing force and increase the effective volume of the overflow chamber as the oil temperature increases; yet while the oil temperature decreases and the oil contracts, the compressible fluid biasing force can overcome the force of friction between the piston seal or second durometer portion of the piston and overflow chamber thereby allowing the compressible fluid to expand and reduce the effective volume of the overflow chamber. In embodiments not shown, the piston can utilize a piston seal and can alternatively have a single portion with a single durometer. In yet other embodiments not shown herein other types of fluids (such as gases), foams, or other resilient materials can be positioned behind the overflow chamber piston under similar principles of operation.

In various embodiments where the overflow chamber piston includes either a single durometer or multiple durometer portions, a sealing portion of the overflow chamber piston is composed of a substantially soft material that provides increased tolerance with respect to the overflow chamber piston and the overflow chamber as the overflow chamber piston contacts and slides within the overflow chamber during operation. In other embodiments, the overflow chamber piston seal creates a fluid tight seal that substantially prevents one or more fluids from bypassing the overflow chamber piston.

Referring to FIGS. 21 and 22, a static overflow chamber (127) is an overflow chamber with a non-variable internal volume (128) for an alternate embodiment which relies on fluid dynamics to allow fluid (oil) volume fluctuation based upon temperature changes. The static overflow chamber (127) can have an overflow chamber top (187) that can be fixed or removable. The chamber in this embodiment is oriented horizontally, as shown, but also includes a vertical component and permits the expansion and contraction of oil volume based upon temperature changes while maintaining an overall internal oil level and pressure that allows the closer to operate normally. As with other embodiments chamber, the oil pressure and level is maintained at levels that ensure normal operation of the closer at all temperatures.

In some embodiments a speed of the closer can be adjusted using a speed control valve, or by prescribed "leakage" from the pressurized to unpressurized hydraulic sides of the overflow chamber piston.

Referring to FIGS. 23 and 24, a gravity-operated overflow chamber (126) is an overflow chamber with a gravity and piston-based variable internal volume of the overflow chamber (129) for an alternate embodiment which relies on fluid dynamics to allow fluid (oil) volume fluctuation based upon temperature changes. The gravity-operated overflow chamber (126) can have an overflow chamber screw plug (186) that can be fixed or removable. The chamber in this embodiment is oriented at least partially vertically (to cause at least some gravitational force to pull the piston toward the earth), or fully vertically, as shown. Preferably, various embodiments of the gravity-operated overflow chamber (126) include at least a vertical component and permits the expansion and contraction of oil volume based upon temperature changes while maintaining an overall internal oil level and pressure that allows the closer to operate normally. As with other embodiments overflow chambers described herein, the oil pressure and level is maintained at levels that ensure normal operation of the closer at all temperatures. FIGS. 25-27 represent various optional embodiments of the gravity-operated overflow chamber over FIG. 24.

As increasing operating temperatures cause the oil volume and pressure to rise the piston also rises, and that as decreasing operating temperatures cause the oil volume and pressure to drop the piston also drops due to the force of gravity. This gravity-based operation is in contrast to embodiments herein that instead utilize a biasing (e.g., coil) spring or compressible fluid that operates as an "air spring." In this sense, the embodiments shown in FIGS. 23 and 24 can be said to utilize a "gravity spring."

Referring to FIG. 25, a close-fitted gravity-operated piston (130) within the gravity-operated overflow chamber is shown. As the close-fitted gravity-operated piston (130) is caused to move by variable pressures, an oil volume can also vary according to temperature. The overflow chamber (129) can be oriented at least partially vertically, and can be of variable height, width, and shape according to various embodiments. According to a variation of the embodiment shown in FIG. 25, the gravity-operated piston (130) is a single durometer overflow chamber piston configured to contact and slide within the overflow chamber such that the single durometer overflow chamber piston seals to the overflow chamber. In various embodiments, the single durometer overflow chamber piston is composed of a substantially soft material that provides increased tolerance with respect to the single durometer overflow chamber piston and the overflow chamber as the single durometer overflow chamber piston contacts and slides within the overflow chamber during operation.

Referring to FIG. 26, a gravity-operated piston (132) is within the gravity-operated overflow chamber, and the gravity-operated piston (132) is attached to a seal (135), which can be a separate component and/or material as compared to piston (132), as shown. As the gravity-operated piston (132) is caused to move by variable pressures, an oil volume can also vary according to temperature. As in FIG. 25, the overflow chamber (129) can be oriented at least partially vertically, and can be of variable height, width, and shape according to various embodiments.

Referring to FIG. 27, a gravity-operated piston (131) is within the gravity-operated overflow chamber, and the gravity-operated piston (131) includes a sealing portion (133), which can be integral with the piston (131). The sealing portion (133) of the piston (131) can be a portion of the piston with a different durometer than another (e.g., non-sealing) portion of piston (131). As the gravity-operated piston (131) is caused to move by variable pressures, an oil volume can also vary according to temperature. As in FIG. 25, the overflow chamber (129) can preferably be oriented at least partially vertically (so as to take advantage of gravity's pull on the gravity-operated piston (131)), and can be of variable height, width, and shape according to various embodiments. In some embodiments, the sealing portion (133) of the piston (131) is composed of a substantially soft material that provides increased tolerance with respect to the piston (131) and the overflow chamber as the single durometer overflow chamber piston contacts and slides within the overflow chamber during operation. In other embodiments, the overflow chamber piston sealing portion (133) creates a fluid tight seal that substantially prevents one or more fluids from bypassing the piston (131).

Selected Embodiments

The following embodiments, designated by letter and number, are intended to further illustrate the present disclosure, but should not be construed to unduly limit this disclosure.

CF1. A hydraulic door closer comprising hydraulic fluid in a housing fitted with i) a biasing spring attached to a piston having geared teeth and a check valve, ii) a geared pinion, iii) a speed control chamber, and iv) a hydraulic fluid overflow chamber, the hydraulic fluid overflow chamber comprising an overflow chamber piston closely fitted to the hydraulic fluid overflow chamber, the overflow chamber piston and the hydraulic fluid overflow chamber forming a sealed compression chamber filled with a compressible fluid that biases the overflow chamber piston when the overflow chamber piston compresses the compressible fluid when the hydraulic fluid is in an expanded state.

CF2. The hydraulic door closer of any of the preceding embodiments wherein the overflow chamber piston closely fitted to the hydraulic fluid overflow chamber creates a fluid tight seal that substantially prevents one or more fluids from bypassing the overflow chamber piston.

CF3. The hydraulic door closer of any of the preceding embodiments wherein the hydraulic fluid overflow chamber has a predetermined volume sufficient to hold expanded hydraulic fluid at an elevated temperature.

CF4. The hydraulic door closer of any of the preceding embodiments wherein the hydraulic fluid overflow chamber maintains an amount of hydraulic fluid so that when the hydraulic fluid contracts there is sufficient hydraulic fluid in the closer.

CF5. The hydraulic door closer of any of the preceding embodiments wherein the hydraulic fluid overflow chamber holds sufficient hydraulic fluid when the hydraulic fluid is in either an expanded or in contracted state.

CF6. The hydraulic door closer of any of the preceding embodiments wherein the hydraulic fluid overflow chamber is a vertical chamber, a horizontal chamber, or an angled chamber.

CF7. The hydraulic door closer of any of the preceding embodiments wherein the hydraulic fluid overflow chamber is in an interior region of the closer.

CF8. The hydraulic door closer of any of the preceding embodiments further comprising a speed control valve.

CF9. The hydraulic door closer of any of the preceding embodiments further comprising horizontal and vertical speed control chamber plugs.

CF10. The hydraulic door closer of any of the preceding embodiments further comprising a hydraulic overflow chamber check valve.

CF11. The hydraulic door closer of any of the preceding embodiments wherein the biasing spring is a compression spring.

CS1. A hydraulic door closer comprising hydraulic fluid in a housing fitted with i) a biasing spring attached to a piston having geared teeth and a check valve, ii) a geared pinion, iii) a speed control chamber, and iv) a hydraulic fluid overflow chamber, the hydraulic fluid overflow chamber comprising an overflow chamber piston closely fitted to the hydraulic fluid overflow chamber, and an overflow chamber spring.

CS2. The hydraulic door closer of any of the preceding embodiments wherein the overflow chamber piston closely fitted to the hydraulic fluid overflow chamber creates a fluid tight seal that substantially prevents one or more fluids from bypassing the overflow chamber piston.

CS3. The hydraulic door closer of any of the preceding embodiments wherein the hydraulic fluid overflow chamber has a predetermined volume sufficient to hold expanded hydraulic fluid at an elevated temperature.

CS4. The hydraulic door closer of any of the preceding embodiments wherein the hydraulic fluid overflow chamber maintains an amount of hydraulic fluid so that when the hydraulic fluid contracts there is sufficient hydraulic fluid in the closer.

CS5. The hydraulic door closer of any of the preceding embodiments wherein the hydraulic fluid overflow chamber holds sufficient hydraulic fluid when the hydraulic fluid is in either an expanded or in contracted state.

CS6. The hydraulic door closer of any of the preceding embodiments wherein the hydraulic fluid overflow chamber is a vertical chamber, a horizontal chamber, or an angled chamber.

CS7. The hydraulic door closer of any of the preceding embodiments wherein the hydraulic fluid overflow chamber is in an interior region of the closer.

CS8. The hydraulic door closer of any of the preceding embodiments further comprising a speed control valve.

CS9. The hydraulic door closer of any of the preceding embodiments further comprising horizontal and vertical speed control chamber plugs.

CS10. The hydraulic door closer of any of the preceding embodiments further comprising a hydraulic overflow chamber check valve.

CS11. The hydraulic door closer of any of the preceding embodiments wherein the biasing spring is a compression spring.

DD1. A hydraulic door closer comprising hydraulic fluid in a housing fitted with i) a biasing spring attached to a piston having geared teeth and a check valve, ii) a geared pinion, iii) a speed control chamber, and iv) a hydraulic fluid overflow chamber comprising an overflow chamber piston having a first portion and a second portion, the first portion having a first durometer and the second portion having a second durometer, wherein the second portion operates as an overflow chamber piston seal, and an overflow chamber spring.

DD2. The hydraulic door closer of any of the preceding embodiments wherein the overflow chamber piston seal creates a fluid tight seal that substantially prevents one or more fluids from bypassing the overflow chamber piston.

DD3. The hydraulic door closer of any of the preceding embodiments wherein the hydraulic fluid overflow chamber has a predetermined volume sufficient to hold expanded hydraulic fluid at an elevated temperature.

DD4. The hydraulic door closer of any of the preceding embodiments wherein the hydraulic fluid overflow chamber maintains an amount of hydraulic fluid so that when the hydraulic fluid contracts there is sufficient hydraulic fluid in the closer.

DD5. The hydraulic door closer of any of the preceding embodiments wherein the hydraulic fluid overflow chamber holds sufficient hydraulic fluid when the hydraulic fluid is in either an expanded or in contracted state.

DD6. The hydraulic door closer of any of the preceding embodiments wherein the hydraulic fluid overflow chamber is a vertical chamber, a horizontal chamber, or an angled chamber.

DD7. The hydraulic door closer of any of the preceding embodiments wherein the hydraulic fluid overflow chamber is in an interior region of the closer.

DD8. The hydraulic door closer of any of the preceding embodiments further comprising a speed control valve.

DD9. The hydraulic door closer of any of the preceding embodiments further comprising horizontal and vertical speed control chamber plugs.

DD10. The hydraulic door closer of any of the preceding embodiments further comprising a hydraulic overflow chamber check valve.

DD11. The hydraulic door closer of any of the preceding embodiments wherein the biasing spring is a compression spring.

SS1. A hydraulic door closer comprising hydraulic fluid in a housing fitted with i) a biasing spring attached to a piston having geared teeth and a check valve, ii) a geared pinion, iii) a speed control chamber, and iv) a hydraulic fluid overflow chamber comprising an overflow chamber piston, and an overflow chamber piston seal, the overflow chamber piston and the hydraulic fluid overflow chamber defining a sealed compression chamber filled with compressible fluid that biases the overflow chamber piston when the overflow chamber piston compresses the compressible fluid when the hydraulic fluid is in an expanded state.

SS2. The hydraulic door closer of any of the preceding embodiments wherein the overflow chamber piston seal creates a fluid tight seal that substantially prevents one or more fluids from bypassing the overflow chamber piston.

SS3. The hydraulic door closer of any of the preceding embodiments wherein the hydraulic fluid overflow chamber has a predetermined volume sufficient to hold expanded hydraulic fluid at an elevated temperature.

SS4. The hydraulic door closer of any of the preceding embodiments wherein the hydraulic fluid overflow chamber maintains an amount of hydraulic fluid so that when the hydraulic fluid contracts there is sufficient hydraulic fluid in the closer.

SS5. The hydraulic door closer of any of the preceding embodiments wherein the hydraulic fluid overflow chamber holds sufficient hydraulic fluid when the hydraulic fluid is in either an expanded or in contracted state.

SS6. The hydraulic door closer of any of the preceding embodiments wherein the hydraulic fluid overflow chamber is a vertical chamber, a horizontal chamber, or an angled chamber.

SS7. The hydraulic door closer of any of the preceding embodiments wherein the hydraulic fluid overflow chamber is in an interior region of the closer.

SS8. The hydraulic door closer of any of the preceding embodiments further comprising a speed control valve.

SS9. The hydraulic door closer of any of the preceding embodiments further comprising horizontal and vertical speed control chamber plugs.

SS10. The hydraulic door closer of any of the preceding embodiments further comprising a hydraulic overflow chamber check valve.

SS11. The hydraulic door closer of any of the preceding embodiments wherein the biasing spring is a compression spring.

DS1. A hydraulic door closer comprising hydraulic fluid in a housing fitted with i) a biasing spring attached to a piston having geared teeth and a check valve, ii) a geared pinion, iii) a speed control chamber, iv) a hydraulic fluid overflow chamber comprising an overflow chamber piston having a first portion and a second portion, the first portion having a first durometer and the second portion having a second durometer, wherein the second portion operates as an overflow chamber piston seal, wherein the overflow chamber piston and the hydraulic fluid overflow chamber form a sealed compression chamber filled with compressible fluid that biases the overflow chamber piston when the overflow chamber piston compresses the compressible fluid when the hydraulic fluid is in an expanded state.

DS2. The hydraulic door closer of any of the preceding embodiments wherein the overflow chamber piston seal creates a fluid tight seal that substantially prevents one or more fluids from bypassing the overflow chamber piston.

DS3. The hydraulic door closer of any of the preceding embodiments wherein the hydraulic fluid overflow chamber has a predetermined volume sufficient to hold expanded hydraulic fluid at an elevated temperature.

DS4. The hydraulic door closer of any of the preceding embodiments wherein the hydraulic fluid overflow chamber maintains an amount of hydraulic fluid so that when the hydraulic fluid contracts there is sufficient hydraulic fluid in the closer.

DS5. The hydraulic door closer of any of the preceding embodiments wherein the hydraulic fluid overflow chamber holds sufficient hydraulic fluid when the hydraulic fluid is in either an expanded or in contracted state.

DS6. The hydraulic door closer of any of the preceding embodiments wherein the hydraulic fluid overflow chamber is a vertical chamber, a horizontal chamber, or an angled chamber.

DS7. The hydraulic door closer of any of the preceding embodiments wherein the hydraulic fluid overflow chamber is in an interior region of the closer.

DS8. The hydraulic door closer of any of the preceding embodiments further comprising a speed control valve.

DS9. The hydraulic door closer of any of the preceding embodiments further comprising horizontal and vertical speed control chamber plugs.

DS10. The hydraulic door closer of any of the preceding embodiments further comprising a hydraulic overflow chamber check valve.

DS11. The hydraulic door closer of any of the preceding embodiments wherein the biasing spring is a compression spring.

GP1. A hydraulic door closer comprising hydraulic fluid in a housing fitted with i) a biasing spring attached to a piston having geared teeth and a check valve, ii) a geared pinion, iii) a speed control chamber, and iv) an at least partially vertical hydraulic fluid overflow chamber comprising a gravity-operated overflow chamber piston, wherein a gravitational force biases the overflow chamber piston when the hydraulic fluid is in an expanded state.

GP2. The hydraulic door closer of any of the preceding embodiments wherein the hydraulic fluid overflow chamber has a predetermined volume sufficient to hold expanded hydraulic fluid at an elevated temperature.

GP3. The hydraulic door closer of any of the preceding embodiments wherein the hydraulic fluid overflow chamber maintains an amount of hydraulic fluid so that when the hydraulic fluid contracts there is sufficient hydraulic fluid in the closer.

GP4. The hydraulic door closer of any of the preceding embodiments wherein the hydraulic fluid overflow chamber holds sufficient hydraulic fluid when the hydraulic fluid is in either an expanded or in contracted state.

GP5. The hydraulic door closer of any of the preceding embodiments wherein the hydraulic fluid overflow chamber is a fully vertical chamber.

GP6. The hydraulic door closer of any of the preceding embodiments wherein the hydraulic fluid overflow chamber is in an interior region of the closer.

GP7. The hydraulic door closer of any of the preceding embodiments further comprising a speed control valve.

GP8. The hydraulic door closer of any of the preceding embodiments further comprising horizontal and vertical speed control chamber plugs.

GP9. The hydraulic door closer of any of the preceding embodiments further comprising a hydraulic overflow chamber check valve.

GP10. The hydraulic door closer of any of the preceding embodiments wherein the biasing spring is a compression spring.

SD1. A hydraulic door closer comprising hydraulic fluid in a housing fitted with i) a biasing spring attached to a piston having geared teeth and a check valve, ii) a geared pinion, iii) a speed control chamber, and iv) a hydraulic fluid overflow chamber comprising a single durometer overflow chamber piston configured to contact and slide within the overflow chamber such that the single durometer overflow chamber piston seals to the overflow chamber, and an overflow chamber spring.

SD2. The hydraulic door closer of any of the preceding embodiments wherein the single durometer overflow chamber piston is composed of a substantially soft material that provides increased tolerance with respect to the single durometer overflow chamber piston and the overflow chamber as the single durometer overflow chamber piston contacts and slides within the overflow chamber.

SD3. The hydraulic door closer of any of the preceding embodiments wherein the single durometer overflow chamber piston creates a fluid tight seal that substantially prevents one or more fluids from bypassing the overflow chamber piston.

SD4. The hydraulic door closer of any of the preceding embodiments wherein the hydraulic fluid overflow chamber has a predetermined volume sufficient to hold expanded hydraulic fluid at an elevated temperature.

SD5. The hydraulic door closer of any of the preceding embodiments wherein the hydraulic fluid overflow chamber maintains an amount of hydraulic fluid so that when the hydraulic fluid contracts there is sufficient hydraulic fluid in the closer.

SD6. The hydraulic door closer of any of the preceding embodiments wherein the hydraulic fluid overflow chamber holds sufficient hydraulic fluid when the hydraulic fluid is in either an expanded or in contracted state.

SD7. The hydraulic door closer of any of the preceding embodiments wherein the hydraulic fluid overflow chamber is a vertical chamber, a horizontal chamber, or an angled chamber.

SD8. The hydraulic door closer of any of the preceding embodiments wherein the hydraulic fluid overflow chamber is in an interior region of the closer.

SD9. The hydraulic door closer of any of the preceding embodiments further comprising a speed control valve.

SD10. The hydraulic door closer of any of the preceding embodiments further comprising horizontal and vertical speed control chamber plugs.

SD11. The hydraulic door closer of any of the preceding embodiments further comprising a hydraulic overflow chamber check valve.

SD12. The hydraulic door closer of any of the preceding embodiments wherein the biasing spring is a compression spring.

OD1. A hydraulic door closer comprising hydraulic fluid in a housing fitted with i) a biasing spring attached to a piston having geared teeth and a check valve, ii) a geared pinion, iii) a speed control chamber, iv) a hydraulic fluid overflow chamber comprising a single durometer overflow chamber piston configured to contact and slide within the overflow chamber such that the single durometer overflow chamber piston seals to the overflow chamber, wherein the single durometer overflow chamber piston and the hydraulic fluid overflow chamber form a sealed compression chamber filled with compressible fluid that biases the single durometer overflow chamber piston when the overflow chamber piston compresses the compressible fluid when the hydraulic fluid is in an expanded state.

OD2. The hydraulic door closer of any of the preceding embodiments wherein the single durometer overflow chamber piston is composed of a substantially soft material that provides increased tolerance with respect to the single durometer overflow chamber piston and the overflow chamber as the single durometer overflow chamber piston contacts and slides within the overflow chamber.

OD3. The hydraulic door closer of any of the preceding embodiments wherein the single durometer overflow chamber piston creates a fluid tight seal that substantially prevents one or more fluids from bypassing the overflow chamber piston.

OD4. The hydraulic door closer of any of the preceding embodiments wherein the hydraulic fluid overflow chamber has a predetermined volume sufficient to hold expanded hydraulic fluid at an elevated temperature.

OD5. The hydraulic door closer of any of the preceding embodiments wherein the hydraulic fluid overflow chamber maintains an amount of hydraulic fluid so that when the hydraulic fluid contracts there is sufficient hydraulic fluid in the closer.

OD6. The hydraulic door closer of any of the preceding embodiments wherein the hydraulic fluid overflow chamber holds sufficient hydraulic fluid when the hydraulic fluid is in either an expanded or in contracted state.

OD7. The hydraulic door closer of any of the preceding embodiments wherein the hydraulic fluid overflow chamber is a vertical chamber, a horizontal chamber, or an angled chamber.

OD8. The hydraulic door closer of any of the preceding embodiments wherein the hydraulic fluid overflow chamber is in an interior region of the closer.

OD9. The hydraulic door closer of any of the preceding embodiments further comprising a speed control valve.

OD10. The hydraulic door closer of any of the preceding embodiments further comprising horizontal and vertical speed control chamber plugs.

OD11. The hydraulic door closer of any of the preceding embodiments further comprising a hydraulic overflow chamber check valve.

OD12. The hydraulic door closer of any of the preceding embodiments wherein the biasing spring is a compression spring.

SV1. A hydraulic door closer comprising hydraulic fluid in a housing fitted with i) a biasing spring attached to a piston having geared teeth and a check valve, ii) a geared pinion, iii) a speed control chamber, and iv) a vertical hydraulic fluid overflow chamber, the hydraulic fluid overflow chamber comprising an overflow chamber piston, wherein the overflow chamber piston is biased when the hydraulic fluid is in an expanded state.

SV2. The hydraulic door closer of any of the preceding embodiments, wherein the overflow chamber piston is selected from the group consisting of a piston with a separate seal, a piston closely fitted to the hydraulic fluid overflow chamber, a piston having a first portion composed of a first durometer and a second portion composed of a second durometer that operates as an overflow chamber piston seal, and a piston composed of a single durometer configured to contact and slide within the overflow chamber such that the single durometer overflow chamber piston seals to the overflow chamber.

SV3. The hydraulic door closer of any of the preceding embodiments, wherein the single durometer overflow chamber piston is composed of a substantially soft material that provides increased tolerance with respect to the single durometer overflow chamber piston and the overflow chamber as the single durometer overflow chamber piston contacts and slides within the overflow chamber.

SV4. The hydraulic door closer of any of the preceding embodiments, wherein the hydraulic fluid overflow chamber is biased by an overflow compression spring.

SV5. The hydraulic door closer of any of the preceding embodiments, wherein the overflow chamber piston and the hydraulic fluid overflow chamber form a sealed compression chamber filled with a compressible fluid that-biases the overflow chamber piston when the overflow chamber piston compresses the compressible fluid when the hydraulic fluid is in an expanded state.

SV6. The hydraulic door closer of any of the preceding embodiments, wherein the overflow chamber piston is a gravity-operated overflow chamber piston, and wherein a gravitational force biases the overflow chamber piston when the hydraulic fluid is in an expanded state.

SV7. The hydraulic door closer of any of the preceding embodiments, wherein the overflow chamber piston creates a fluid tight seal that substantially prevents one or more fluids from bypassing the overflow chamber piston.

SV8. The hydraulic door closer of any of the preceding embodiments wherein the hydraulic fluid overflow chamber has a predetermined volume sufficient to hold expanded hydraulic fluid at an elevated temperature.

SV9. The hydraulic door closer of any of the preceding embodiments wherein the hydraulic fluid overflow chamber maintains an amount of hydraulic fluid so that when the hydraulic fluid contracts there is sufficient hydraulic fluid in the closer.

SV10. The hydraulic door closer of any of the preceding embodiments wherein the hydraulic fluid overflow chamber holds sufficient hydraulic fluid when the hydraulic fluid is in either an expanded or in contracted state.

SV11. The hydraulic door closer of any of the preceding embodiments wherein the hydraulic fluid overflow chamber is in an interior region of the closer.

SV12. The hydraulic door closer of any of the preceding embodiments further comprising a speed control valve.

SV13. The hydraulic door closer of any of the preceding embodiments further comprising horizontal and vertical speed control chamber plugs.

SV14. The hydraulic door closer of any of the preceding embodiments further comprising a hydraulic overflow chamber check valve.

SH1. A hydraulic door closer comprising hydraulic fluid in a housing fitted with i) a biasing spring attached to a piston having geared teeth and a check valve, ii) a geared pinion, iii) a speed control chamber, and iv) a horizontal hydraulic fluid overflow chamber, the hydraulic fluid overflow chamber comprising an overflow chamber piston, wherein the overflow chamber piston is biased when the hydraulic fluid is in an expanded state.

SH2. The hydraulic door closer of any of the preceding embodiments, wherein the overflow chamber piston is selected from the group consisting of a piston with a separate seal, a piston closely fitted to the hydraulic fluid overflow chamber, a piston having a first portion composed of a first durometer and a second portion composed of a second durometer that operates as an overflow chamber piston seal, and a piston composed of a single durometer configured to contact and slide within the overflow chamber such that the single durometer overflow chamber piston seals to the overflow chamber.

SH3. The hydraulic door closer of any of the preceding embodiments, wherein the single durometer overflow chamber piston is composed of a substantially soft material that provides increased tolerance with respect to the single durometer overflow chamber piston and the overflow chamber as the single durometer overflow chamber piston contacts and slides within the overflow chamber.

SH4. The hydraulic door closer of any of the preceding embodiments, wherein the hydraulic fluid overflow chamber is biased by an overflow compression spring.

SH5. The hydraulic door closer of any of the preceding embodiments, wherein the overflow chamber piston and the hydraulic fluid overflow chamber form a sealed compression chamber filled with a compressible fluid that-biases the overflow chamber piston when the overflow chamber piston compresses the compressible fluid when the hydraulic fluid is in an expanded state.

SH6. The hydraulic door closer of any of the preceding embodiments, wherein the overflow chamber piston creates a fluid tight seal that substantially prevents one or more fluids from bypassing the overflow chamber piston.

SH7. The hydraulic door closer of any of the preceding embodiments wherein the hydraulic fluid overflow chamber has a predetermined volume sufficient to hold expanded hydraulic fluid at an elevated temperature.

SH8. The hydraulic door closer of any of the preceding embodiments wherein the hydraulic fluid overflow chamber maintains an amount of hydraulic fluid so that when the hydraulic fluid contracts there is sufficient hydraulic fluid in the closer.

SH9. The hydraulic door closer of any of the preceding embodiments wherein the hydraulic fluid overflow chamber holds sufficient hydraulic fluid when the hydraulic fluid is in either an expanded or in contracted state.

SH10. The hydraulic door closer of any of the preceding embodiments wherein the hydraulic fluid overflow chamber is in an interior region of the closer.

SH11. The hydraulic door closer of any of the preceding embodiments further comprising a speed control valve.

SH12. The hydraulic door closer of any of the preceding embodiments further comprising horizontal and vertical speed control chamber plugs.

SH13. The hydraulic door closer of any of the preceding embodiments further comprising a hydraulic overflow chamber check valve.

AH1. A hydraulic door closer comprising hydraulic fluid in a housing fitted with i) a biasing spring attached to a piston having geared teeth and a check valve, ii) a geared pinion, iii) a speed control chamber, and iv) an angled hydraulic fluid overflow chamber, the hydraulic fluid overflow chamber comprising an overflow chamber piston, wherein the overflow chamber piston is biased when the hydraulic fluid is in an expanded state.

AH2. The hydraulic door closer of any of the preceding embodiments, wherein the overflow chamber piston is selected from the group consisting of a piston with a separate seal, a piston closely fitted to the hydraulic fluid overflow chamber, a piston having a first portion composed of a first durometer and a second portion composed of a second durometer that operates as an overflow chamber piston seal, and a piston composed of a single durometer configured to contact and slide within the overflow chamber such that the single durometer overflow chamber piston seals to the overflow chamber.

AH3. The hydraulic door closer of any of the preceding embodiments, wherein the single durometer overflow chamber piston is composed of a substantially soft material that provides increased tolerance with respect to the single durometer overflow chamber piston and the overflow chamber as the single durometer overflow chamber piston contacts and slides within the overflow chamber.

AH4. The hydraulic door closer of any of the preceding embodiments, wherein the hydraulic fluid overflow chamber is biased by an overflow compression spring.

AH5. The hydraulic door closer of any of the preceding embodiments, wherein the overflow chamber piston and the hydraulic fluid overflow chamber form a sealed compression chamber filled with a compressible fluid that-biases the overflow chamber piston when the overflow chamber piston compresses the compressible fluid when the hydraulic fluid is in an expanded state.

AH6. The hydraulic door closer of any of the preceding embodiments, wherein the overflow chamber piston is a gravity-operated overflow chamber piston, and wherein a gravitational force biases the overflow chamber piston when the hydraulic fluid is in an expanded state.

AH7. The hydraulic door closer of any of the preceding embodiments, wherein the overflow chamber piston creates a fluid tight seal that substantially prevents one or more fluids from bypassing the overflow chamber piston.

AH8. The hydraulic door closer of any of the preceding embodiments wherein the hydraulic fluid overflow chamber has a predetermined volume sufficient to hold expanded hydraulic fluid at an elevated temperature.

AH9. The hydraulic door closer of any of the preceding embodiments wherein the hydraulic fluid overflow chamber maintains an amount of hydraulic fluid so that when the hydraulic fluid contracts there is sufficient hydraulic fluid in the closer.

AH10. The hydraulic door closer of any of the preceding embodiments wherein the hydraulic fluid overflow chamber holds sufficient hydraulic fluid when the hydraulic fluid is in either an expanded or in contracted state.

AH11. The hydraulic door closer of any of the preceding embodiments wherein the hydraulic fluid overflow chamber is in an interior region of the closer.

AH12. The hydraulic door closer of any of the preceding embodiments further comprising a speed control valve.

AH13. The hydraulic door closer of any of the preceding embodiments further comprising horizontal and vertical speed control chamber plugs.

AH14. The hydraulic door closer of any of the preceding embodiments further comprising a hydraulic overflow chamber check valve.

NA1. A door closer comprising fluid in a housing fitted with a biasing spring in operative communication with a closer piston, and a vertical fluid overflow chamber comprising an overflow chamber piston, wherein the overflow chamber piston is biased when the fluid volume changes.

NA2. The door closer of any of the preceding embodiments, wherein the door closer is a hydraulic door closer comprising hydraulic fluid in the housing.

NA3. The door closer of any of the preceding embodiments, wherein the overflow chamber piston is selected from the group consisting of a piston with a separate seal, a piston closely fitted to the vertical fluid overflow chamber, a piston having a first portion composed of a first durometer and a second portion composed of a second durometer that operates as an overflow chamber piston seal, and a piston composed of a single durometer.

NA4. The door closer of any of the preceding embodiments, wherein the overflow chamber piston is configured to contact and slide within the vertical fluid overflow chamber such that the overflow chamber piston seals to the vertical fluid overflow chamber NA5. The door closer of any of the preceding embodiments, wherein the single durometer overflow chamber piston is composed of a substantially soft material that provides increased tolerance with respect to the single durometer overflow chamber piston and the vertical fluid overflow chamber as the single durometer overflow chamber piston contacts and slides within the vertical fluid overflow chamber.

NA6. The door closer of any of the preceding embodiments, wherein the overflow chamber piston is biased by an overflow biasing spring.

NA7. The door closer of any of the preceding embodiments, wherein the overflow chamber piston is biased by a deformable material that is configured to return to its original shape and size after deformation.

NAB. The door closer of any of the preceding embodiments, wherein the overflow chamber piston and the vertical fluid overflow chamber form a sealed compression chamber filled with a compressible fluid that biases the overflow chamber piston when the overflow chamber piston compresses the compressible fluid when the fluid is in an expanded state.

NA9. The door closer of any of the preceding embodiments, wherein the overflow chamber piston is a gravity-biased overflow chamber piston, and wherein a gravitational force biases the overflow chamber piston when the fluid is in an expanded state.

NA10. The door closer of any of the preceding embodiments, wherein the overflow chamber piston creates a fluid tight seal that substantially prevents one or more fluids from bypassing the overflow chamber piston.

NA11. The door closer of any of the preceding embodiments, wherein the fluid overflow chamber has a predetermined volume sufficient to hold expanded fluid at an elevated temperature.

NA12. The door closer of any of the preceding embodiments, wherein the fluid overflow chamber maintains an amount of fluid so that when the fluid contracts there is sufficient fluid in the closer.

NA13. The door closer of any of the preceding embodiments, wherein the fluid overflow chamber holds sufficient fluid when the fluid is in either an expanded or in contracted state.

NA14. The door closer of any of the preceding embodiments, wherein the fluid overflow chamber is in an interior region of the closer.

NA15. The door closer of any of the preceding embodiments, further comprising a speed control valve.

NA16. The door closer of any of the preceding embodiments, further comprising horizontal and vertical speed control chamber plugs.

NA17. The door closer of any of the preceding embodiments, further comprising a hydraulic overflow chamber check valve.

NB1. A door closer comprising fluid in a housing fitted with a biasing spring in operative communication with a closer piston, and a horizontal fluid overflow chamber comprising an overflow chamber piston, wherein the overflow chamber piston is biased when the fluid is in an expanded state.

NB2. The door closer of any of the preceding embodiments, wherein the door closer is a hydraulic door closer comprising hydraulic fluid in the housing.

NB3. The door closer of any of the preceding embodiments, wherein the overflow chamber piston is selected from the group consisting of a piston with a separate seal, a piston closely fitted to the horizontal fluid overflow chamber, a piston having a first portion composed of a first durometer and a second portion composed of a second durometer that operates as an overflow chamber piston seal, and a piston composed of a single durometer.

NB4. The door closer of any of the preceding embodiments, wherein the single durometer overflow chamber piston is composed of a substantially soft material that provides increased tolerance with respect to the single durometer overflow chamber piston and the horizontal fluid overflow chamber as the single durometer overflow chamber piston contacts and slides within the horizontal fluid overflow chamber.

NB5. The door closer of any of the preceding embodiments, wherein the overflow chamber piston is biased by an overflow biasing spring.

NB6. The door closer of any of the preceding embodiments, wherein the overflow chamber piston is biased by a deformable material that is configured to return to its original shape and size after deformation.

NB7. The door closer of any of the preceding embodiments, wherein the overflow chamber piston and the horizontal fluid overflow chamber form a sealed compression chamber filled with a compressible fluid that biases the overflow chamber piston when the overflow chamber piston compresses the compressible fluid when the fluid is in an expanded state.

NB8. The door closer of any of the preceding embodiments, wherein the overflow chamber piston creates a fluid tight seal that substantially prevents one or more fluids from bypassing the overflow chamber piston.

NB9. The door closer of any of the preceding embodiments, wherein the fluid overflow chamber has a predetermined volume sufficient to hold expanded fluid at an elevated temperature.

NB10. The door closer of any of the preceding embodiments, wherein the fluid overflow chamber maintains an amount of fluid so that when the fluid contracts there is sufficient fluid in the closer.

NB11. The door closer of any of the preceding embodiments, wherein the fluid overflow chamber holds sufficient fluid when the fluid is in either an expanded or in contracted state.

NB12. The door closer of any of the preceding embodiments, wherein the fluid overflow chamber is in an interior region of the closer.

NB13. The door closer of any of the preceding embodiments, further comprising a speed control valve.

NB14. The door closer of any of the preceding embodiments, further comprising horizontal and vertical speed control chamber plugs.

NB15. The door closer of any of the preceding embodiments, further comprising a hydraulic overflow chamber check valve.

NC1. A door closer comprising fluid in a housing fitted with a biasing spring in operative communication with a closer piston, and an angled fluid overflow chamber comprising an overflow chamber piston, wherein the overflow chamber piston is biased when the fluid is in an expanded state.

NC2. The door closer of any of the preceding embodiments, wherein the door closer is a hydraulic door closer comprising hydraulic fluid in the housing.

NC3. The door closer of any of the preceding embodiments, wherein the overflow chamber piston is selected from the group consisting of a piston with a separate seal, a piston closely fitted to the angled fluid overflow chamber, a piston having a first portion composed of a first durometer and a second portion composed of a second durometer that operates as an overflow chamber piston seal, and a piston composed of a single durometer.

NC4. The door closer of any of the preceding embodiments, wherein the single durometer overflow chamber piston is composed of a substantially soft material that provides increased tolerance with respect to the single durometer overflow chamber piston and the angled fluid overflow chamber as the single durometer overflow chamber piston contacts and slides within the angled fluid overflow chamber.

NC5. The door closer of any of the preceding embodiments, wherein the overflow chamber piston is biased by an overflow biasing spring.

NC6. The door closer of any of the preceding embodiments, wherein the overflow chamber piston is biased by a deformable material that is configured to return to its original shape and size after deformation.

NC7. The door closer of any of the preceding embodiments, wherein the overflow chamber piston and the angled fluid overflow chamber form a sealed compression chamber filled with a compressible fluid that-biases the overflow chamber piston when the overflow chamber piston compresses the compressible fluid when the fluid is in an expanded state.

NC8. The door closer of any of the preceding embodiments, wherein the overflow chamber piston is a gravity-biased overflow chamber piston, and wherein a gravitational force biases the overflow chamber piston when the fluid is in an expanded state.

NC9. The door closer of any of the preceding embodiments, wherein the overflow chamber piston creates a fluid tight seal that substantially prevents one or more fluids from bypassing the overflow chamber piston.

NC10. The door closer of any of the preceding embodiments, wherein the fluid overflow chamber has a predetermined volume sufficient to hold expanded fluid at an elevated temperature.

NC11. The door closer of any of the preceding embodiments, wherein the fluid overflow chamber maintains an amount of fluid so that when the fluid contracts there is sufficient fluid in the closer.

NC12. The door closer of any of the preceding embodiments, wherein the fluid overflow chamber holds sufficient fluid when the fluid is in either an expanded or in contracted state.

NC13. The door closer of any of the preceding embodiments, wherein the fluid overflow chamber is in an interior region of the closer.

NC14. The door closer of any of the preceding embodiments, further comprising a speed control valve.

NC15. The door closer of any of the preceding embodiments, further comprising horizontal and vertical speed control chamber plugs.

NC16. The door closer of any of the preceding embodiments, further comprising a hydraulic overflow chamber check valve.

ND1. A door closer comprising fluid in a housing fitted with a biasing spring in operative communication with a closer piston, and a fluid overflow chamber, wherein the fluid overflow chamber has a predetermined volume sufficient to hold expanded fluid at an elevated temperature.

ND2. The door closer of any of the preceding embodiments, wherein the door closer is a hydraulic door closer comprising hydraulic fluid in the housing.

ND3. The door closer of any of the preceding embodiments, wherein the fluid overflow chamber has a predetermined volume sufficient to hold expanded fluid at an elevated temperature.

ND4. The door closer of any of the preceding embodiments, wherein the fluid overflow chamber maintains an amount of fluid so that when the fluid contracts there is sufficient fluid in the closer.

ND5. The door closer of any of the preceding embodiments, wherein the fluid overflow chamber holds sufficient fluid when the fluid is in either an expanded or in contracted state.

ND6. The door closer of any of the preceding embodiments, wherein the fluid overflow chamber is in an interior region of the closer.

ND7. The door closer of any of the preceding embodiments, further comprising a speed control valve.

ND8. The door closer of any of the preceding embodiments, further comprising horizontal and vertical speed control chamber plugs.

ND9. The door closer of any of the preceding embodiments, further comprising a hydraulic overflow chamber check valve.

Various modifications and alterations of this disclosure will become apparent to those skilled in the art without departing from the scope and principles of this disclosure, and it should be understood that this disclosure is not to be unduly limited to the illustrative embodiments set forth hereinabove.

What is claimed is:

1. A door closer comprising fluid in a housing fitted with a biasing spring in operative communication with a closer piston, and an overflow chamber piston positioned at least partially within a vertical fluid overflow chamber, wherein the overflow chamber piston is biased when the fluid volume changes.

2. The door closer of claim 1, wherein the door closer is a hydraulic door closer comprising hydraulic fluid in the housing.

3. The door closer of claim 1, wherein the overflow chamber piston is selected from the group consisting of: a piston with a separate seal, a piston closely fitted to the vertical fluid overflow chamber, a piston having a first portion composed of a first durometer and a second portion composed of a second durometer that operates as an overflow chamber piston seal, and a piston composed of a single durometer.

4. The door closer of claim 3, wherein the overflow chamber piston is configured to contact and slide within the vertical fluid overflow chamber such that the overflow chamber piston seals to the vertical fluid overflow chamber.

5. The door closer of claim 3, wherein the overflow chamber piston is biased by an overflow biasing spring.

6. The door closer of claim 3, wherein the overflow chamber piston is biased by a deformable material that is configured to return to its original shape and size after deformation.

7. The door closer of claim 3, wherein the overflow chamber piston and the vertical fluid overflow chamber form a sealed compression chamber filled with a compressible fluid that biases the overflow chamber piston when the overflow chamber piston compresses the compressible fluid when the fluid is in an expanded state.

8. The door closer of claim 3, wherein the overflow chamber piston is a gravity-biased overflow chamber piston, and wherein a gravitational force biases the overflow chamber piston when the fluid is in an expanded state.

9. The door closer of claim 3, wherein the overflow chamber piston creates a fluid tight seal that substantially prevents one or more fluids from bypassing the overflow chamber piston.

10. A door closer comprising fluid in a housing fitted with a biasing spring in operative communication with a closer piston, and an overflow chamber piston positioned at least partially within a horizontal fluid overflow chamber, wherein the overflow chamber piston is biased when the fluid volume changes.

11. The door closer of claim 10, wherein the door closer is a hydraulic door closer comprising hydraulic fluid in the housing.

12. The door closer of claim 10, wherein the overflow chamber piston is selected from the group consisting of: a piston with a separate seal, a piston closely fitted to the horizontal fluid overflow chamber, a piston having a first portion composed of a first durometer and a second portion composed of a second durometer that operates as an overflow chamber piston seal, and a piston composed of a single durometer.

13. The door closer of claim 12, wherein the overflow chamber piston is biased by an overflow biasing spring.

14. The door closer of claim 12, wherein the overflow chamber piston is biased by a deformable material that is configured to return to its original shape and size after deformation.

15. The door closer of claim 12, wherein the overflow chamber piston and the horizontal fluid overflow chamber form a sealed compression chamber filled with a compressible fluid that biases the overflow chamber piston when the overflow chamber piston compresses the compressible fluid when the fluid is in an expanded state.

16. The door closer of claim 12, wherein the overflow chamber piston creates a fluid tight seal that substantially prevents one or more fluids from bypassing the overflow chamber piston.

17. The door closer of claim 10, wherein the overflow chamber piston is configured to contact and slide within the horizontal fluid overflow chamber such that the overflow chamber piston seals to the horizontal fluid overflow chamber.

18. A door closer comprising fluid in a housing fitted with a biasing spring in operative communication with a closer piston, and an overflow chamber piston positioned at least partially within an angled fluid overflow chamber, wherein the overflow chamber piston is biased when the fluid volume changes.

19. The door closer of claim 18, wherein the door closer is a hydraulic door closer comprising hydraulic fluid in the housing.

20. The door closer of claim 18, wherein the overflow chamber piston is selected from the group consisting of: a piston with a separate seal, a piston closely fitted to the angled fluid overflow chamber, a piston having a first portion composed of a first durometer and a second portion composed of a second durometer that operates as an overflow chamber piston seal, and a piston composed of a single durometer.

21. The door closer of claim 20, wherein the overflow chamber piston is biased by an overflow biasing spring.

22. The door closer of claim 20, wherein the overflow chamber piston is biased by a deformable material that is configured to return to its original shape and size after deformation.

23. The door closer of claim 20, wherein the overflow chamber piston and the angled fluid overflow chamber form a sealed compression chamber filled with a compressible fluid that-biases the overflow chamber piston when the overflow chamber piston compresses the compressible fluid when the fluid is in an expanded state.

24. The door closer of claim 20, wherein the overflow chamber piston is a gravity-biased overflow chamber piston, and wherein a gravitational force biases the overflow chamber piston when the fluid is in an expanded state.

25. The door closer of claim 20, wherein the overflow chamber piston creates a fluid tight seal that substantially prevents one or more fluids from bypassing the overflow chamber piston.

26. The door closer of claim 18, wherein the overflow chamber piston is configured to contact and slide within the angled fluid overflow chamber such that the overflow chamber piston seals to the angled fluid overflow chamber.

27. A door closer comprising fluid in a housing fitted with a biasing spring in operative communication with a closer piston, and an overflow piston positioned at least partially within a fluid overflow chamber, wherein the fluid overflow chamber has a predetermined volume sufficient to hold expanded fluid at an elevated temperature.

* * * * *